US010018369B2

(12) United States Patent
Kawano

(10) Patent No.: US 10,018,369 B2
(45) Date of Patent: Jul. 10, 2018

(54) AIR CURTAIN DEVICE

(71) Applicant: KAWANO GIKEN CO., LTD., Fukuoka (JP)

(72) Inventor: Michihiko Kawano, Fukuoka (JP)

(73) Assignee: KAWANO GIKEN CO., LTD., Fukuoka (JP)

( * ) Notice: Subject to any disclaimer, the term of this patent is extended or adjusted under 35 U.S.C. 154(b) by 141 days.

(21) Appl. No.: 14/946,144

(22) Filed: Nov. 19, 2015

(65) Prior Publication Data

US 2017/0038085 A1 Feb. 9, 2017

(30) Foreign Application Priority Data

Aug. 7, 2015 (JP) ..... 2015-157583

(51) Int. Cl.
*F15D 1/04* (2006.01)
*F24F 9/00* (2006.01)
(Continued)

(52) U.S. Cl.
CPC ..... *F24F 9/00* (2013.01); *A47L 9/02* (2013.01); *B03C 3/011* (2013.01); *B03C 3/41* (2013.01);
(Continued)

(58) Field of Classification Search
CPC ..... F15D 1/04; F24F 13/081; F24F 2013/088; F16L 43/001
(Continued)

(56) References Cited

U.S. PATENT DOCUMENTS 4,137,750 A * 2/1979 French ..... G01N 27/64 250/281
4,919,170 A * 4/1990 Kallinich ..... F15D 1/04 138/39
(Continued)

FOREIGN PATENT DOCUMENTS

EP 2 517 909 A1 10/2012
JP 2-115642 A 4/1990
(Continued)

OTHER PUBLICATIONS

"Jet Engineering" written by Toshihiko Yashirokochi, Morikata Shuppan Co., Ltd. 2004, p. 4.
(Continued)

*Primary Examiner* — Robert A Hopkins
*Assistant Examiner* — Minh-Chau Pham
(74) *Attorney, Agent, or Firm* — Griffin and Szipl PC

(57) ABSTRACT

[Object of the Invention] An object of the present invention is to develop an air curtain device generating parallel air flow based on the knowledge in that parallel air flow generated at the outlet of a turbulent flow runup zone does not include vortex flows and has strong air current interruption performance.

[Disclosure of the Invention] An air curtain device comprises a first ventilation box comprising a discharge elbow provided with guide vanes, a honeycomb, an industrial use ventilating fan, a suction elbow provided with guide vanes, and a pre-filter, wherein the aforesaid elements are sequentially accommodated in a rectangular box whose one side surface is open and an outlet port of the discharge elbow provided with guide vanes and the pre-filter are disposed on the open side surface of the rectangular box, and a second ventilation box of the same structure as the first ventilation box, wherein the first ventilation box is put on an entrance floor with the discharge elbow provided with guide vanes
(Continued)

above, and the second ventilation box is put on the entrance floor with the discharge elbow provided with guide vanes below, so that the first ventilation box and the second ventilation box oppose each other at their open side surfaces in a mutually upside-down manner and the first ventilation box and the second ventilation box are distanced from each other by a breadth Xg of the entrance, and wherein an entrance ceiling is provided to a breadth equal to the distance between the ventilation boxes so as to connect a top of the first ventilation box with a top of the second ventilation box, thereby forming an air curtain device entrance, wherein relation between the breadth Xg of the entrance of the air curtain device and a breadth D of the outlet ports of the discharge elbows provided with guide vanes is set at Xg≤5D.

4 Claims, 26 Drawing Sheets

(51) Int. Cl.
*A47L 9/02* (2006.01)
*B03C 3/011* (2006.01)
*B03C 3/41* (2006.01)

(52) U.S. Cl.
CPC ..... *B03C 2201/08* (2013.01); *B03C 2201/14* (2013.01); *F24F 2009/007* (2013.01)

(58) Field of Classification Search
USPC ..... 55/385.1; 285/156, 176, 179; 138/39; 406/191, 195
See application file for complete search history.

(56) References Cited

U.S. PATENT DOCUMENTS

| | | | | |
|---|---|---|---|---|
| 6,290,266 | B1 * | 9/2001 | Kawano | F15D 1/04 138/39 |
| 8,251,406 | B2 | 8/2012 | Kawano | |
| 2011/0168482 | A1 * | 7/2011 | Merchant | F01D 25/30 181/213 |
| 2011/0241334 | A1 * | 10/2011 | Kawano | F15D 1/04 285/179 |

FOREIGN PATENT DOCUMENTS

| | | | |
|---|---|---|---|
| JP | 2-135109 | A | 5/1990 |
| JP | 7-269524 | A | 10/1995 |
| JP | 2948199 | B2 | 7/1999 |
| JP | 2002-28502 | A | 1/2002 |
| JP | 2007-010184 | A | 1/2007 |
| JP | 2007-278577 | A | 10/2007 |
| JP | 2008-215724 | A | 9/2008 |
| JP | 4884547 | B2 | 12/2011 |
| JP | 5207563 | B1 | 3/2013 |
| JP | 2013-145104 | A | 7/2013 |
| JP | 2014-035844 | A | 2/2014 |

OTHER PUBLICATIONS

Technical material "Fluid Flow Resistance of Pipe and Duct" The Japan Society of Mechanical Engineers, 1991, p. 23.
Technical material "Fluid Flow Resistance of Pipe and Duct" The Japan Society of Mechanical Engineers, 1991, p. 26.
Technical material "New Edition of Factory Ventilation" The Air Conditioning and Hygiene Engineering Society, 2009, p. 44.
Technical material "Fluid Flow Resistance of Pipe and Duct" The Japan Society of Mechanical Engineers, 1991, p. 48.
Technical material "Fluid Flow Resistance of Pipe and Duct" The Japan Society of Mechanical Engineers, 1991, p. 25.
"Dictionary of Flow" compiled by Tsutomu Kanbe, Maruzen Co. Ltd., 2004, p. 472.
"Elimination target and various filters (1) Particulate Contaminants" written by Seiichi Takizawa, Air-Conditioning and Sanitation, vol. 76, No. 10, p. 7.
Japan Vilene Co., Ltd. "Regeneration Type Filter, Catalogue".
"Outline of Mechanical Engineering" written by Yutaka Yamada, et al., Asakura Shoten, 1988, p. 111.
Mitsubishi Ventilation Fan General Catalogue, 2014, p. 565,566.
"Advisory Committee on Eradication of Unnecessary Energy in Shop Operation and Energy Saving, Discussion Results" Tokyo Metropolitan Government—Bureau of Environment, Department of Environment of City and the Earth, Planning and Coordination Division, Nov. 2012.
"Guideline for Actions Against Tobacco Use in Offices" Ministry of Health, Labour and Welfare, 2005.
Guideline for New Facility Planning for Infectious Disease Sick Room Health Publishing, 2001, p. 157.
Office Action issued in corresponding Japanese application 2015-157583 dated Nov. 2, 2015 (no translation available; submitted for certification).

* cited by examiner

PRIOR ART

PRIOR ART

AIR CURTAIN DEVICE

This application claims priority from Japanese Patent Application No. 2015-157583, filed Aug. 7, 2015, the entire disclosure of which is incorporated herein by reference.

FIELD OF THE INVENTION

The present invention relates to an air curtain device.

BACKGROUND OF THE INVENTION

An air curtain device is one among air jet application devices. Air jet application technology related to the air curtain device will be described.

Each of FIGS. 1(*a*) and 1(*b*) shows speed distribution of a free air jet discharged from a nozzle into a static environment according to a non-patent document No. 1. Each of the speed distributions can be divided into a first region neighboring the nozzle and a second region downstream of the first region. The first region neighboring the nozzle is called an initial region, with a jet core present in the center, and the jet core is surrounded by a mixing region, wherein the jet and the surrounding fluid mix with each other to form a mixed flow including vortex flows. The mixing region expands and the jet core region diminishes as the distance from the nozzle outlet increases. Thus, the core region finally terminates. A region downstream of the position where the core region terminates is called a developed region, wherein the mixed flow diffuses.

The jet core shown in FIG. 1(*a*) is an irrotational parallel flow core, i.e., a parallel flow core which does not include vortex flows, generated by a nozzle formed by a turbulent flow runup zone outlet in a three-dimensional axisymmetric duct shown in FIG. 2. Length $X_1$ of the parallel flow core is $X_1 \approx 10D$.

The jet core shown in FIG. 1(*b*) is a mixed flow core including vortex flows generated by a two-dimensional nozzle. Length $X_2$ of the mixed flow core is $X_2 \approx 6D$ The parallel flow core of FIG. 1(*a*) shows strong air current interruption performance because the parallel flow core is an irrotational flow, i.e., a flow which does not include vortex flows. The mixed flow core of FIG. 1(*b*) shows weak air current interruption performance because the mixed flow is a vortex-including flow.

The mixing region is formed around each of the jet cores shown in FIGS. 1(*a*) and 1(*b*) as a result of a large speed gradient between the jet core and the surrounding fluid and an accompanying contribution from viscous fluid flow. An outer periphery of the mixing region forms a jet outer edge. A suction flow is generated on the jet outer edge due to the accompanying action of viscous fluid flow. The suction flow draws surrounding fluid into the mixing region.

FIG. 2 shows a runup zone of turbulent flow in which the parallel flow core of FIG. 1(*a*) is generated according to a non-patent document No. 2. Mixed fluid flow including vortex flows enters an inlet of the turbulent flow runup zone. A boundary layer of small thickness is generated on a duct wall. As the fluid flow moves downstream, thickness of the boundary layer gradually increases and the vortex flows gradually decrease. When the fluid flow advances by a distance La, La being called runup zone length, the vortex flows dissipate and a parallel flow, i.e. an irrotational flow, with a dish shaped speed distribution is generated. The parallel flow advances in the duct at a steady state speed, while keeping a constant speed distribution. Thus, the dish shaped speed distribution advances in parallel. As described above, the vortex flows exist at the inlet of the runup zone, but dissipate in the runup zone, and thus, the parallel flow not including the vortex flows is generated at the outlet of the runup zone. According to a non-patent document No. 3, the runup zone length La is La≈50D (D is duct breadth when the runup zone is formed by a duct of rectangular cross section and diameter when the runup zone is formed by a duct of circular cross section).

FIG. 3 shows a two dimensional slot nozzle according to a non-patent document No. 4. A jet core screen generated by the two dimensional slot nozzle includes vortex flows and shows weak air current interruption performance. However, the two dimensional slot nozzle is widely used for conventional air curtain devices because it is easily manufactured.

FIG. 4(*a*) shows contour lines of equal speed flows of a thoroughly developed turbulent parallel flow in a duct of rectangular cross section after passing through a runup zone according to a non patent document No. 5. FIG. 4(*b*) shows speed distribution of a thoroughly developed turbulent parallel flow after passing through a runup zone according to a non patent document No. 6. As can be seen from FIGS. 4(*a*) and 4(*b*), a thoroughly developed turbulent parallel flow in a duct forms an axial speed distribution symmetric to X-X axis and Z-Z axis and forms a parallel flow, i.e., an irrotational flow, in which all speed components have vectors pointing in the same direction.

FIG. 5(*a*) shows a parallel flow core generated by a nozzle formed by an outlet of a runup zone of rectangular shaped cross section. FIG. 5(*b*) shows a parallel flow core screen generated by the nozzle formed by an outlet of a runup zone of rectangular shaped cross section when only the ceiling and the floor of the duct are extended from the nozzle. An air curtain device formed by the parallel flow core screen has an advanced feature.

PRIOR ART DOCUMENTS

Patent Documents

Document No. 1: Japanese Patent No. 4884547 & U.S. Pat. No. 8,251,406 "Discharge Elbow provided with Guide Vanes"

Document No. 2: Japanese Patent No. 2948199 & U.S. Pat. No. 6,290,266 "Suction Elbow provided with Guide Vanes"

Document No. 3: Japanese Patent Laid-Open Publication No. 2014-035844 "Ion generator and destaticizing device equipped with the ion generator"

Non Patent Documents

Document No. 1: "Jet Engineering" written by Toshihiko YASHIROKOCHI, Morikata Shuppan Co., Ltd. 2004, p. 4

Document No. 2: Technical material "Fluid Flow Resistance of Pipe and Duct" The Japan Society of Mechanical Engineers, 1991, p. 23

Document No. 3: Technical material "Fluid Flow Resistance of Pipe and Duct" The Japan Society of Mechanical Engineers, 1991, p. 26

Document No. 4: Technical material "New Edition of Factory Ventilation" The Air Conditioning and Hygiene Engineering Society, 2009, p. 44

Document No. 5: Technical material "Fluid Flow Resistance of Pipe and Duct" The Japan Society of Mechanical Engineers, 1991, p. 48

Document No. 6: Technical material "Fluid Flow Resistance of Pipe and Duct" The Japan Society of Mechanical Engineers, 1991, p. 25

Document No. 7: "Dictionary of Flow" compiled by Tsutomu KANBE, Maruzen Co. Ltd., 2004, p. 472

Document No. 8: "Elimination target and various filters (1) Particulate Contaminants" written by Seiichi TAKIZAWA, Air-Conditioning and Sanitation, Vol. 76, No. 10, p. 7

Document No. 9: Japan Vilene Co., Ltd. "Regeneration Type Filter, Catalogue"

Document No. 10: "Outline of Mechanical Engineering" written by Yutaka YAMADA, et al., Asakura Shoten, 1988, p. 111

Document No. 11: Mitsubishi Ventilation Fan General Catalogue, 2014, p. 565, 566

Document No. 12: "Advisory Committee on Eradication of Unnecessary Energy in Shop Operation and Energy Saving, Discussion Results" Tokyo Metropolitan Government—Bureau of Environment, Department of Environment of City and the Earth, Planning and Coordination Division, 2012 November Document No. 13: "Guideline for Actions Against Tobacco Use in Offices" Ministry of Health, Labour and Welfare, 2005

Document No. 14: "Guideline for New Facility Planning for Infectious Disease Sick Room" Health Publishing, 2001, p. 157

SUMMARY OF THE INVENTION

Problem to be Solved

An object of the present invention is to develop a parallel flow air curtain device using the parallel flow core screen shown in FIG. 5(*b*), which does not include vortex flows, instead of a conventional mixed flow air curtain device provided with a two-dimensional slot nozzle shown in FIG. 3 and generating a mixed flow including vortex flows.

Means for Solving the Problem

An axisymmetric internally circulating parallel flow air curtain device with oppositely directed upper level and lower level air flows in accordance with one embodiment of the present invention will be described based on a specific example shown in FIG. 6. A parallel flow air curtain device 200 comprises a first ventilation box 100*a*, a second ventilation box 100*b* and an entrance ceiling 8. Outlet ports of the air curtain device 200 have a breadth of D, the entrance has height of 2L, and the entrance has a breadth Xg of Xg≤5D. Though length $X_1$ of the parallel flow core is $X_1 \approx 10D$ as shown in FIG. 1(*a*), the breadth Xg of the entrance is set at ½ of 10D so as to reliably maintain the strength of the parallel flow core. The first ventilation box 100*a* and the second ventilation box 100*b* have the same structure and comprise rectangular boxes 1*a*, 1*b*, one side surface of each of which is open, discharge elbows provided with guide vanes 2*a*, 2*b*, honeycombs 3*a*, 3*b*, industrial use ventilating fans 4*a*, 4*b*, suction elbows provided with guide vanes 5*a*, 5*b*, and pre-filters 6*a*, 6*b*, wherein the aforesaid elements are sequentially accommodated in the rectangular boxes 1*a*, 1*b*, and outlet ports 14*a*, 14*b* of the discharge elbows provided with guide vanes 2*a*, 2*b* and the pre-filters 6*a*, 6*b* are disposed on the open side surfaces of the rectangular boxes 1*a*, 1*b*. The outlet ports 14*a* and 14*b* have the same height L. The first ventilation box 100*a* is put on an entrance floor with the discharge elbow provided with guide vanes 2*a* above, and the second ventilation box 100*b* is put on the entrance floor with the discharge elbow provided with guide vanes 2*b* below, so that the first ventilation box 100*a* and the second ventilation box 100*b* oppose each other at their open side surfaces in a mutually upside-down manner and the first ventilation box 100*a* and the second ventilation box 100*b* are distanced from each other by the breadth Xg of the entrance. The entrance ceiling 8 is provided to a breadth equal to the distance between the ventilation boxes 100*a* and 100*b* so as to connect a top of the first ventilation box 100*a* with a top of the second ventilation box 100*b*, thereby forming an air curtain device entrance. Particulars of the pre-filters 6*a*, 6*b* are in accordance with non patent documents No. 8 and No. 9.

In the present parallel flow air curtain device 200, the first ventilation box 100*a* and the second ventilation box 100*b* oppose each other at their open side surfaces in a mutually upside-down manner, so that a higher level non-axisymmetric outlet port and a lower level non-axisymmetric outlet port oppose each other axisymmetrically with respect to a center horizontal plane 10, so that an upper level axially asymmetric jet flow core screen 20*a* and a lower level axially asymmetric jet flow core screen 20*b* flow in opposite directions axisymmetrically with respect to a center horizontal plane 10. Free shear vortex street 11 (see FIG. 12) due to Kelvin-Helmholtz instability, which is discussed in the non patent document No. 7, is formed on the center horizontal plane 10. The free shear vortex street 11 connects the upper level axially asymmetric jet flow core screen 20*a* with the lower level axially asymmetric jet flow core screen 20*b* so as to make them irrotational parallel flows, thereby forming an upper level parallel flow air curtain and a lower level parallet flow air curtain. Thus, there is generated an internally circulating axisymmetric jet flow core screen of upper level and lower level oppositely directed air flows, which is axisymmetric with respect to the free shear vortex street 11. Thus, the axisymmetric internally circulating parallel flow air curtain device 200 shown in FIG. 6 is obtained. As can be seen from FIG. 13, it was demonstrated by an actual device test that the air curtain device 200 wherein the upper level outlet port 14*a* and the lower level outlet port 14*b* oppose each other can generate a parallel flow air curtain axisymmetric with respect to a central axis 10 in a manner similar to a three dimensional rectangular outlet nozzle axisymmetric with respect to a central axis 10.

As can be seen from FIG. 2, a mixed fluid flow including vortex flows enters an inlet of a turbulent flow runup zone, vortex flows gradually decrease as the fluid flow advances in the runup zone, and a parallel flow which does not include vortex flows and in which all speed components have vectors pointing in the same direction is generated at an outlet of the runup zone. Therefore, the runup zone operates as a zone for eliminating the vortex flows.

The speed distribution of the parallel flow in transverse cross section generated at the outlet of a runup zone of a rectangular section duct shown in FIG. 4(*a*) can be regarded as a speed distribution of a combined-axisymmetric parallel flow wherein upper level axially asymmetric speed distribution above the center line X-X is connected to a lower level axially asymmetric speed distribution below the center line X-X. Therefore, the axisymmetric internally circulating parallel flow air curtain device 200 with upper level and lower level oppositely directed air flows shown in FIG. 6 can be regarded as an axisymmetric air curtain device wherein the axially asymmetric outlet port 14*a* of the discharge elbow provided with guide vanes 2*a* is located on the upper side and the axially asymmetric outlet port 14*b* of the discharge elbow provided with guide vanes 2*b* is located on the lower side. In accordance with the present air curtain device, dynamic pressure recovery effect due to flow expansion of the discharge elbow makes it possible to use an industrial use ventilating fan of large flow rate and low output pressure as a driving fan.

The discharge elbows provided with guide vanes 2*a* and 2*b* are the one disclosed in Japanese Patent No. 4884547 & U.S. Pat. No. 8,251,406 (Patent Document No. 1), and as shown in FIG. 7, comprise an elbow of rectangular cross section and expansion ratio f of $1<f\leq 5$, and one or more guide vanes disposed in the elbow, while the guide vane or the guide vanes are made of a curved plate and a pair of flat plates connected to the curved plate, with one of them being located in front of the curved plate and the other being located to the rear of the curved plate, wherein m number of sub-channels similar to one another are formed in the elbow based on the following formulas, whereafter the inner sidewall of the elbow is deformed into a curved plate coaxial with the curved plate of the adjacent guide vane to deform n=1 sub-channel into a coaxial bend channel provided with a uniform breadth equal to the inlet breadth $b_1$ of the sub-channel.

$$p=h/\{[f/(f-r)]^m-1\} \quad (1)$$

$$a_n=pr[f/(f-r)]^n \quad (2)$$

$$b_n=a_n/f \quad (3)$$

$$f=W_0/h \quad (4)$$

$$W=W_0-(a_1-b_1) \quad (5)$$

p: overhang length at the outlet of the elbow
h: inlet length of the elbow
$W_0$: baseline outlet length of the elbow
W: outlet length of the elbow
f: expansion ratio of the elbow ($f=W_0/h$, $1<f\leq 5$)
r: aspect ratio of the sub-channels (sub-channel breadth/sub-channel length)
$r=(B_2C_1)/(A_1C_1)=(B_3C_2)/(A_2C_2)=(B_4C_3)/(A_3C_3)=(B_5C_4)/(A_4C_4)$ (see FIG. 7)
m: number of sub-channels ($m\geq 2$)
$a_n$: outlet breadth of n-th sub-channel ($a_0$ indicates the radius of curvature of the inner sidewall and $a_m$ indicates the radius of curvature of the outer sidewall)
$b_n$: inlet breadth of n-th sub-channel As can be seen from FIG. 7, a discharge elbow provided with guide vanes of inlet breadth h and baseline outlet breadth $W_0$ is designed based on the formulas (1), (2), (3) and (4). Thereafter, the inner sidewall is moved toward the first guide vane by a distance ($a_1-b_1$) so as to make a first sub-channel of breadth $b_1$. r is a function of expansion ratio of the elbow f and inclination angle 90° of jet from the elbow. r is actual measurement value.

FIG. 8 shows streamlines of a jet generated by the discharge elbow provided with guide vanes shown in FIG. 7. Mixed rotation air flow generated by the industrial use ventilating fan 4*a* of the air curtain device shown in FIG. 6 passes through the honeycomb 3*a* shown in FIG. 15 so as to become free from rotational components, and thereafter enters the discharge elbow 2*a*. In the discharge elbow 2*a*, the air flow is bent by 90° by guide vanes and becomes homogeneous in speed distribution under applied centrifugal force. All sub-channels are similar and have the same flow resistance. Therefore, air flow speed at the outlet 14 of the elbow shown in FIG. 8 becomes the same at every guide vane except the inner side wall and the outer side wall. Though the discharged air flow forms an asymmetrical axial speed distribution, all speed components have vectors pointing substantially in the same direction. The sub-channels shown in FIG. 8 are expansion channels similar to one another, so that a stationary vortex is generated in the rear of each guide vane. The vortices, which are similar to one another, contribute to generation of stable expansion flow.

FIG. 9 shows a photo of a jet flow screen corresponding to the streamlines of the jet shown in FIG. 8. From many such photos, an aspect ratio r of the sub-channels can be determined that achieves a jet directed at right angles to the flat surface of the outlet of the elbow given a predetermined expansion ratio f of the elbow. Thus, correlation between r and f is determined. The jet flow screen shown in FIG. 9 is not a parallel flow core screen but a mixed flow core screen, because the section of the outlet is not axisymmetric. The jet from the discharge elbow forms asymmetric axial flow speed distribution as described above. However, all speed components have vectors pointing substantially in the same direction.

The suction elbows provided with guide vanes 5*a* and 5*b* are the one disclosed in Japanese Patent No. 2948199 & U.S. Pat. No. 6,290,266 (Patent Document No. 2), and comprise, as shown in FIG. 10(*a*), an elbow of rectangular cross section and contraction ratio f of $1<f\leq 5$, and one or more guide vanes made of a curved plate and flat plates connected to the curved plate disposed so as to make the shapes of the sub-channels defined thereby similar to each other based on the following formulas.

$$p=h/\{[f/(f-r)]^m-1\} \quad (6)$$

$$a_n=Pr[f/(f-r)]^n \quad (7)$$

$$b_n=a_n/f \quad (8)$$

p: overhang length at the inlet of the elbow
h: outlet length of the elbow
W: inlet length of the elbow
f: contraction ratio of the elbow ($f=W/h$, $1<f\leq 5$)
r: aspect ratio of the sub-channels (sub-channel breadth/sub-channel length)
$r=(B_2C_1)/(A_1C_1)=(B_3C_2)/(A_2C_2)=(B_4C_3)/(A_3C_3)=(B_5C_4)/(A_4C_4)$ (see FIG. 10)
m number of sub-channels ($m\geq 2$)
$a_n$: inlet breadth of n-th sub-channel ($a_0$ indicates the radius of curvature of the inner sidewall and $a_m$ indicates the radius of curvature of the outer sidewall)
$b_n$: outlet breadth of n-th sub-channel A suction elbow obtained by the formulas (6), (7) and (8) has the same shape as a discharge elbow obtained by the formulas (1), (2) and (3).

FIG. 10(*b*) shows speed distribution of suction flow of the suction elbow whose contraction ratio of the elbow f is 5.0 and inlet length of the elbow W is 1,000 mm. This suction elbow has an excellent uniform suction characteristic. Therefore, the suction elbows 5*a* and 5*b* located rearward of the pre-filters 6*a* and 6*b* achieve uniform suction through the whole areas of the pre-filters 6*a* and 6*b*, make it possible to use pre-filters of small pressure loss, and reduce initial outlet port pressure $P_1$ of the industrial use ventilating fans 4*a* and 4*b*, thereby enabling long continuous operation of the air curtain device.

FIG. 11 shows a suction elbow 5 which is located rearward of the pre-filters 6*a* and 6*b* in the air curtain device shown in FIG. 6. The suction elbow 5 supports about half of the surface area of the pre-filter 6 so as to suck the air through the supporting area. Air is sucked through another half of the surface area of the pre-filter 6 by the industrial use ventilating fan 4 and flows into the fan 4 from a circumferential edge of the inlet port of the fan 4. Thus, air is sucked uniformly through the whole surface area of the pre-filter 6.

FIG. 12 shows a free shear vortex street 11 disclosed in a non patent document No. 7, which is formed on the center horizontal plane 10 due to Kelvin-Helmholtz instability. In the parallel flow air curtain device of FIG. 6, the free shear vortex street 11 connects the higher level axially asymmetric jet core screen 20*a* with the lower level axially asymmetric jet core screen 20*b* so as to generate a composite internally circulating parallel flow air curtain of higher level and lower level oppositely directed air flows, which are axisymmetric with respect to the free shear vortex street 11. The higher level axially asymmetric jet core screen 20*a* and the lower level axially asymmetric jet core screen 20*b* flow in the opposite directions at the same mean speed and symmetrically to each other. Thus, every vortex in the free shear vortex street 11 in FIG. 12(*b*) has the same size.

FIG. 13 shows an example of measured flow speed distribution of the air curtain device 200 of claim 1 shown in FIG. 6. Entrance height 2L, outlet port breadth D, and entrance breadth Xg of the parallel flow air curtain device used for measurement of air flow speed distribution are 2L=2,100 mm, D=400 mm and Xg=5D=2,000 mm. The higher level axially asymmetric jet core screen 20*a* and the lower level axially asymmetric jet core screen 20*b* flow in opposite directions, so to facilitate the judgment of the flow state, measured flow speeds at various points in the higher level axially asymmetric jet core screen 20*a* and measured flow speeds at various points in the lower level axially asymmetric jet core screen 20*b* are plotted by black dot marks • in the same direction. Flow speed measurements were carried out on three vertical lines (1), (2) and (3) which quadrisect the entrance breadth Xg (Xg=2,000 mm). Flow speed measurement is impossible at the vertical middle of the entrance because of the presence of the free shear vortex street 11, every vortex included in the free shear vortex street 11 being a stationary vortex flow. Therefore, no black dot mark is present at the vertical middle of the entrance. As can be seen from FIG. 13, each of the flow speed distributions on the vertical lines (1), (2) and (3) has a dish-like shape. Mean values of the flow speed distributions on the vertical lines (1), (2) and (3) are all the same, namely, 3.1 m/s. Judging from the measurement results, the flow state is a parallel flow, wherein horizontal flow is maintained with a specific flow speed kept on every stream line and a specific flow speed distribution moves in parallel. The measurement verified that the higher level axially asymmetric jet core screen 20*a* and the lower level axially asymmetric jet core screen 20*b* flowing in opposite directions can form an axisymmetric parallel flow air curtain.

Furthermore, the measurement verified that the suction flow generated on the jet outer edge of the mixed flow region shown in FIG. 1 is uniformly generated on the whole surface of the jet outer edge and suction speed is uniformly 0.2 m/s when the mean jet speed is 3.1 m/s. The suction flow is generated on either side of the air curtain and on the whole surface of the air curtain (2100 mm height×2000 mm breadth) so as to accompany floating particles and take them into the air curtain.

The measurement verified that the air flow screen generated by the axisymmetric internally circulating flow air curtain device of higher level and lower level oppositely directed air flows shown in FIG. 6 is the parallel flow core screen shown in FIG. 5(*b*). Therefore, the air curtain device 200 shown in FIG. 6 is a parallel flow air curtain device Method of designing a parallel flow air curtain device will be described.

FIG. 14 shows mechanical elements installed in the ventilation box 100*a* of the parallel flow air curtain device 200 and symbols of static pressure and flow speed at various points. Particulars of the pre-filter 6*a* are in accordance with non-patent documents No. 8 and No. 9.

FIG. 15 shows a reduction flow duct 12 provided at a connection part between the discharge elbow 2*a* and the honeycomb 3*a* when the outlet port breadth D of the discharge elbow 2*a* is reduced to a level smaller than the diameter F of the industrial use ventilating fan 4*a*. The honeycomb 3*a* eliminates rotation components of the air flow.

Tables 1 and 2 show design parameters of the parallel flow air curtain device and examples of designed air curtain devices. In accordance with the air curtain device of the present invention, dynamic pressure recovery effect of the discharge elbow ($\Delta P_1$ of formula 16) makes it possible for the industrial use ventilating fan to operate at free air flow rate. Method of designing the parallel flow air curtain device whose industrial use ventilating fans operate at free air flow rate is described hereinafter.

$$V_2=Qa/LD \quad (9)$$

$$V_2=2.0 \text{ to } 3.5 \text{ m/s (guide value for personal safety)} \quad (10)$$

$$f=W/h=L/F \ (1<f\leq 5) \quad (11)$$

$$V_1=fV_2 \quad (12)$$

$$X_1=KD \ (1<K\leq 5) \quad (13)$$

$$V_3=Qa/LE \quad (14)$$

$$\Delta P_0=H_0(V_3/V_0)^2(>0) \quad (15) \text{ (see non patent document No. 9)}$$

$$\Delta P_1=(\rho V_1^2/2)(1/f^2-1) \quad (16) \text{ (see non patent document No. 10)}$$

$$P_1=\Delta P_0+\Delta P_1 \quad (17)$$

F: Industrial use ventilating fan diameter
D: Outlet port breadth of the discharge elbow (D=F) (see FIG. 6)
2L: Height of the entrance (see FIG. 6)
L: Height of the outlet port of the discharge elbow (W=L) (see FIG. 6)
L: Height of the pre-filter (see FIG. 6)
W: Outlet port length of the discharge elbow (see FIG. 7)
h: Inlet port length of the discharge elbow (h=D)
f: Expansion ratio of the discharge elbow (f=W/h, 1<f≤5)
$P_1$: Initial outlet port pressure of the industrial use ventilating fan (gauge pressure)
$\Delta P_1$: Recovery value of dynamic pressure (Pa)
Qa: Free air flow rate of the industrial use ventilating fan ($m^3$/s) (air flow rate when $P_1$=0, i.e., standard atmospheric pressure)
ρ: Density of air=1.204 (kg/$m^3$)
A: Inlet port area of the discharge elbow=$D^2$ ($m^2$)
$V_1$: Initial air flow speed at inlet port of the discharge elbow=Qa/A (m/s)
$V_2$: Initial air flow speed at outlet port of the discharge elbow (m/s)=$V_1$/f
E: Pre-filter breadth (m)
$V_3$: Initial suction air flow speed of the pre-filter (m/s)

$V_0$: Standard air flow speed of the pre-filter (m/s) (non-patent document No. 9)

$H_0$: Standard pressure loss of the pre-filter (Pa) (non-patent document No. 9)

$\Delta P_0$: Initial pressure loss of the pre-filter (Pa) (non-patent document No. 9)

$X_1$: Initial region length of turbulent free jet (parallel flow core length $X_1 \leq 10D$) (see FIG. 1)

Xg: Entrance breadth of the air curtain device $Xg \leq 5D$ (see FIG. 6)

K: Expansion ratio of parallel flow air curtain length

Note: The parallel flow core length $X_1$ is $X_1 \leq 10D$ according to the experiment carried out on a three dimensional duct outlet nozzle shown in FIG. 1(*a*). In the present air curtain device, the design entrance breadth Xg is set at $Xg \leq 5D$ so as to maintain the strength of the air flow screen.

Tables 1 and 2 show design examples of the parallel flow air curtain device wherein the diameter of the industrial use ventilating fan is set at 400 mm and 500 mm, and the entrance height is set at 2,100 mm (for people), 2,500 mm (for cars) and 2,800 mm (for cars).

TABLE 1

| No<br>Item<br>Unit<br>Symbol | 1<br>Height of entrance<br>mm<br>2L | 2<br>Venti-lating fan diameter<br>mm<br>F | 3<br>Free air flow rate<br>$m^3/s$<br>Qa | 4<br>Outlet port breadth<br>mm<br>D | 5<br>Outlet air speed<br>m/s<br>$V_2$ | 6<br>Entrance breadth<br>mm<br>Xg | 7<br>Expan-sion ratio<br>f |
|---|---|---|---|---|---|---|---|
| Exampe 1 | 2,100 | 400 | 1.333 | 400 | 3.17 | 2,000 | 2.63 |
| Example 2 | 2,500 | 400 | 1.333 | 340 | 3.14 | 1,700 | 3.13 |
| Example 3 | 2,800 | 500 | 1.983 | 420 | 3.26 | 2,100 | 3.80 |

TABLE 2

| | 8 | 9 | 10 | 11 | 12 | 13 |
|---|---|---|---|---|---|---|
| | Pre-fitter | | | | | Initial outlet port pressure |
| No<br>Item<br>Unit<br>Symbol<br>Formula | Breadth<br>m<br>E | Area<br>$m^2$<br>L · E | Initial air flow speed<br>m/s<br>$V_3$<br>(14) | Initial pressure loss<br>Pa<br>$\Delta P_0$<br>(15) | Recovery of dynamic pressure<br>Pa<br>$\Delta P_1$<br>(16) | of venti-lating fan<br>Pa<br>$P_1$<br>(17) |
| Example 1 | 0.60 | 0.63 | 2.1 | 21.6 | −35.7 | −14.1 |
| Example 2 | 0.60 | 0.75 | 1.8 | 15.3 | −52.1 | −36.8 |
| Example 3 | 0.70 | 0.98 | 2.0 | 18.3 | −43.8 | −25.5 |

Operation method of the parallel flow air curtain device will be described.

The parallel flow air curtain device in accordance with the present invention implements the dynamic pressure recovery effect shown by the formula (16) so as to start operation with the initial outlet port pressure $P_1$ of the industrial use ventilating fan negative, provided that the pre-filter is in initial condition. In the case of calculation example No. 1, the operation starts with the initial outlet port pressure $P_1$ of the industrial use ventilating fan −14.1 Pa. The value $P_1$ is displayed on a pressure gauge attached to the air curtain device. As the pre-filter becomes contaminated, pressure loss of the pre-filter increases and the value $P_1$ rises from negative to zero (gauge pressure). While the value $P_1$ rises from negative to zero, the air curtain device operates at a constant air flow rate equal to the free air flow rate of the industrial use ventilating fan and at a constant air flow speed $V_2 \approx 3.2$ m/s. When the value $P_1$ becomes positive owing to progressive contamination of the pre-filter, air flow rate decreases and air flow speed decreases. When $V_2$ decreases to a level near 2 m/s, the pre-filter is replaced with a new one.

In an operation example at an injection molding factory, shown in FIG. 26, the pre-filter was replaced with a new one after 24 hours continuous operation because a lot of floating solid plastic fine particles were generated in the factory. In an operation example at painting factory, shown in FIG. 27, replacement interval of the pre-filter became longer because pressure loss increase rate of the pre-filter was relatively low owing to the floating dust being constituted of fine particles of paint liquid.

An example of ventilation performance of the parallel flow air curtain device will be described.

Ventilation performance of the parallel flow air curtain device of 2,100 mm entrance height and 2,000 mm entrance breadth shown in Calculation example No. 1 in Tables 1 and 2 is calculated.

1. Flow rate of indoor suction air Q1 (=Q2)

Q1=Entrance area×V4=2.1 m×2 m×0.2 m/s=0.84 $m^3/s$=3,024 $m^3/h$

V4: Speed of the indoor suction air flow 23, V4≈0.2 m/s (measured value)

2. Ventilated room volume W

Number of ventilations n=Q1/W

W=Q1/n, The number of ventilations n=8 (In the case of ordinary office use)

Room volume W=Q1/n=3,024/8≈370 $m^3$

3. Floor area of the Ventilated room A

A=370/3≈120 $m^2$ (Height of the ventilated room is 3 m)

As can be seen from the aforesaid calculation, each side of the present air curtain device can clean indoor air of a room of 120 $m^2$ floor area.

4. Floor area of the Ventilated room A when the parallel flow air curtain device is installed in a room instead of at the entrance of the room is 240 $m^2$.

An ionized parallel flow air curtain device in accordance with the invention of claim 3 of the present application will be described based on a specific example shown in FIG. 16. An ionized parallel flow air curtain device 300 comprises ion generating poles 27*a* and 27*b* attached to the center of the outlet ports 14*a* and 14*b* of the air curtain device 200 used in air flow speed distribution measurement of FIG. 13. Measured destaticizing performance of the ionized parallel flow air curtain device 300 is shown by a line (2) in FIG. 18.

A line (1) in FIG. 18 shows destaticizing performance of a conventional blower-type destaticizing device shown in FIG. 17, which comprises a small fan of about 120 mm diameter and discharge needles that discharge ions into air flow of the fan so as to form ionized air flow. The line (1) is taken from non-patent document No. 3.

As can be seen from FIG. 18, destaticizing distance at destaticizing time of 1 second is 10 cm in the case of the line (1) and 50 cm in the case of the line (2), and at destaticizing time of 2 seconds is 40 cm in the case of the line (1) and 80 cm in the case of the line (2). The conventional blower-type destaticizing device uses a mixed air flow including vortex flows so that plus ions and minus irons collide and are extinguished. As a result, the destaticizing distance becomes short. On the other hand, the ionized parallel flow air curtain device uses a parallel air flow that does not include vortex flows so that contact between plus ions and minus irons is restricted and loss of ions is minimized. As a result, the destaticizing distance becomes long. In the ionized parallel flow air curtain device 300, entrance breadth Xg can be set at Xg≈80 cm as the destaticizing distance when destaticizing time is set at 2 seconds.

An ionized parallel flow air curtain device 300 of entrance breadth of Xg≈80 cm is shown in FIG. 19.

When it is assumed that it takes 2 seconds for a person to walk through the air curtain (thickness of the air curtain is 400 mm) of the ionized parallel flow air curtain device 300, entrance breadth Xg≈80 cm becomes an effective destaticizing distance.

When a pair of ionized parallel flow air curtain devices 300 are installed in tandem as shown in FIG. 20, the entrance breadth Xg can be set at Xg≈160 cm. A small car can pass through the pair of ionized parallel flow air curtain devices 300 installed in tandem so as to be destaticized.

FIG. 21 shows air flow distribution when the parallel flow air curtain device 200 or 300 is installed in an open entrance of a class 1 ventilated room 29 provided with a supply ventilating fan 32 and an exhaust ventilating fan 33. Flow rate of mechanical air supply Q3 and flow rate of mechanical air exhaust Q4 are Q3≈Q4, and internal pressure Pr of the ventilated room 29 is Pr≈0. Suction air flows 23 and 24 are generated along jet outer edges 25 and 26, and an indoor suction flow rate Q1 and an outdoor suction flow rate Q2 are caused by an upper level parallel flow core screen 20*a*. Internal circulation air flow rate Qa of the air curtain device is kept constant during operation of the air curtain device, so that the indoor suction flow rate Q1 is equal to indoor circulation flow rate Q5.

A lower level circulation flow 39 is generated by the lower level parallel flow core screen 20*b* shown in FIG. 6, and an upper level circulation flow 40 is generated by the upper level parallel flow core screen 20*a* shown in FIG. 6. Indoor floating dust and adherent dust are taken into a mixed flow region 21 along with the lower level circulation flow 39 and the upper level circulation flow 40 so that part of the dusts are captured by the pre-filters 6*a* and 6*b*. The dust removal process is carried out continuously so that the indoor air is cleaned. The aforesaid technology can be widely used for factories and offices, such as retail stores, restaurants, hospitals, hotels, schools, service facilities, etc.

FIG. 22 shows air flow distribution when the parallel flow air curtain device 200 or 300 is installed in an open entrance of a class 2 ventilated room 30 provided with a supply ventilating fan 34 and a vent 35, wherein flow rate of mechanical air supply Q7 and flow rate of natural exhaust Q8 are Q7>Q8 and indoor pressure Pr of the ventilated room 30 is Pr>0. Harmful outdoor floating particles are prevented from entering the class 2 ventilated room 30. The relation among indoor circulation flow rate Q9, indoor suction flow rate Q1, mechanical air supply flow rate Q7 and natural exhaust flow rate Q8 is Q9=Q1−(Q7−Q8).

A lower level circulation flow 39 is generated by the lower level parallel flow core screen 20*b* shown in FIG. 6, and an upper level circulation flow 40 is generated by the upper level parallel flow core screen 20*a* shown in FIG. 6.

Indoor floating dust particles are taken into a mixed flow region 21 along with the lower level circulation flow 39 and the upper level circulation flow 40 so that part of the particles are captured by the pre-filters 6*a* and 6*b*. Dust particles adhering to humans, objects etc. are detached and captured by the pre-filters 6*a* and 6*b*. Dust particles of diameter equal to or larger than 5 μm, such as street floating dusts, pollen, Pm10, down contaminated with bird flu virus, radioactive particles, etc. are captured by the pre-filters 6*a* and 6*b*. The aforesaid technology can be widely used for clean rooms, operating rooms, sick rooms, closed type poultry houses, high radiation dose rest rooms, emergency measures rooms of nuclear power plants, etc.

FIG. 23 shows air flow distribution when the parallel flow air curtain device 200 or 300 is installed in an open entrance of a class 3 ventilated room 31 provided with an exhaust ventilating fan 36 and an inlet 37, wherein flow rate of mechanical air exhaust Q11 and flow rate of natural air supply Q12 are Q11>Q12 and indoor pressure Pr is Pr<0. Indoor contaminants are prevented from discharging into the environment. The relation among indoor circulation flow rate Q13, indoor suction flow rate Q1, mechanical exhaust flow rate Q11 and natural air supply flow rate Q12 is Q13=Q1+(Q11−Q12)

A lower level circulation flow 39 is generated by the lower level parallel flow core screen 20*b* shown in FIG. 6, and an upper level circulation flow 40 is generated by the upper level parallel flow core screen 20*a* shown in FIG. 6.

Indoor floating dust particles are taken into a mixed flow region 21 along with the lower level circulation flow 39 and the upper level circulation flow 40 so that part of the particles are captured by the pre-filters 6*a* and 6*b*. Dust particles adhering to humans, objects etc. are detached and captured by pre-filters 6*a* and 6*b*. The aforesaid technology can be widely used for rooms in which contaminated air flows and floating contaminants are generated, such as smoking rooms, kitchens, rest rooms, paint booths, injection molding factories, asbestos workshops, etc.

Effect of the Invention

Exchange of indoor air and removal of floating dust are carried out by mechanical ventilation and temperature control is carried out by air conditioning so as to adjust indoor environmental conditions such as temperature, humidity, air flow speed, cleanliness, etc. However, entrances of factories, facilities, shops, etc. are usually left open for convenience of workers, transport vehicles, customers, etc. Therefore, in summer air conditioned cold air and in winter air conditioned warm air discharges through the open entrance. It is said that about 50% of air conditioning power is wasted.

Furthermore, street floating dust, pollen, kosa (Asian mineral dust), Pm10, volcanic ash, mosquitoes carrying diseases (dengue fever, malaria, etc.), radioactive floating dust, etc. flow into the factories, facilities, shops, etc., while bad odors from kitchens and rest rooms, tobacco smoke from smoking rooms, floating dust generated in factories, paint liquid mist in drying rooms, floating asbestos dust, droplets including infectious disease pathogens, etc. discharge from the factories, facilities, shops, etc. and cause environment problems.

According to non-patent document No. 12, 70% of 200,000 shops in Tokyo, such as retail business shops, restaurants, etc., usually leave their entrances open. There are estimated to be more than 200,000 open entrances in Tokyo if factories are included. Judging from this data, a vast number of open entrances are thought to exist worldwide. Therefore, development of an air curtain device for effectively preventing air conditioning energy loss and environmental pollution has been desired.

Applications of the inventions of claims 1 and 2 are as follows.

1. Factory entrance 1-1: Manufacturing factory, 1-2: Assembling factory, 1-3: Sewing factory, 1-4: Freezing-refrigerating warehouse, 1-5: Clean room, 1-6: Painting booth, 1-7: Asbestos processing chamber, 1-8: Food processing factory, 1-9: Plant factory, 1-10: Closed type poultry house 2. Office entrance 2-1: Smoking room (non-patent document No. 13), 2-2: Restaurant, 2-3: Shop, 2-4: Office, 2-5: Hotel, 2-6: School, 2-7: Hospital (Sick room, Intensive care unit, Operating room, etc.), 2-8: High radiation dose rest room, 2-9: Emergency measures room of nuclear power plant, 2-10: Service facility (Airport lobby, Exhibition hall room, Art museum, etc.)

3. Others 3-1: Air cleaner installed in a room 3-2: Destaticizing device installed in a room Effects of the air curtain device of the present invention are as follows.

1. Prevention of Inflow and Outflow of Warm Air and Cold Air.

When the air curtain device in accordance with the present invention is installed in the entrance of an air-conditioned room, refrigerated warehouse, etc., inflow and outflow of warm air and cold air are prevented so as to reduce air conditioning power loss, thereby achieving energy saving.

2. Prevention of Inflow of Humidity During Rainy Weather

When the air curtain device in accordance with the present invention is installed in the entrance of a factory, inflow of humid air is prevented on a rainy day so that, for example, foods can be protected against mold, and metal products and precision dies against rust.

3. Uniformization of Indoor Air Temperature

When the air curtain device in accordance with the present invention is installed in the entrance of a factory, circulating air flow is generated in the factory so that air temperature in the factory is uniformized and productivity is enhanced.

4. Realization of Smoking Room Conforming to Guideline

Japan's Ministry of Health, Labour and Welfare published a smoking room guideline (non-patent document No. 13) which requires 1. prevention of leakage of smoke and odor of tobacco smoke from an entrance, 2. ensuring an air flow speed toward the entrance of 0.2 m/s, and 3. ensuring a floating dust density in the smoking room of not greater than 0.15 mg/m$^3$.

A smoking room provided with the air curtain device in accordance with the present invention at an entrance and an exhaust fan corresponds to the class 3 ventilated room provided with the air curtain device shown in FIG. 23. In the smoking room, leakage of indoor tobacco smoke from the entrance is prevented by the air curtain device. Air flow speed of 0.2 m/s toward the entrance is ensured by the suction air flow 24 shown in FIG. 23. Floating dust density in the smoking room of not greater than 0.15 mg/m$^3$ is ensured, as can be seen from the results of the measurement carried out in the injection molding factory shown in FIG. 26, wherein density of floating dust of 5 μm or larger particle diameter is 300 particles/ft$^3$ or less. The air curtain device of the present invention takes tobacco smoke into the mixed flow region 21 by the indoor circulation air flows 39 and 40, filters the tobacco smoke with the pre-filters 6*a* and 6*b* so as to capture tar components, and discharges tobacco smoke removed of tar components with the exhaust fan. Therefore, the smoking room provided with the air curtain device of the present invention does not suffer from heavy tar adhesion and strong tar odor.

5. Capture of Outdoor Floating Dust and Adherent Dust

The parallel flow air curtain device and the ionized parallel flow air curtain device can capture floating dust and adherent dust of 5 μm or larger particle diameter (non-patent document No. 9). The parallel flow air curtain device and the ionized parallel flow air curtain device can capture street floating dust, bacteria, mold, insects, hair, pollen, kosa, PM10, disease-carrying mosquitoes, radioactive floating dust, bird flu virus contaminated floating dust, down, etc. Outdoor floating fine particles of less than 5 μm diameter that pass through the air curtain device disperse in the atmosphere and indoor floating fine particles of less than 5 μm diameter are captured by air cleaners provided with HEPA filters.

6. Floating dust particles generated indoors, such as floating asbestos dust, dust generated in a factory, industrial use plastic dust, floating oil liquid mist, paint mist, etc. can be captured by the pre-filters.

7. Prevention of Infectious Diseases

When the air curtain device in accordance with the present invention is installed in a sickroom, droplets including infectious disease pathogens such as MERS coronavirus, SARS coronavirus (non-patent document No. 14) etc. can be captured. When, the air curtain device in accordance with the present invention is installed outdoors, mosquitoes carrying diseases (dengue fever, malaria, etc.) can be captured.

8. Cleaning of Indoor Air

When the density of floating dust of 5 μm or larger particle diameter in indoor air is high, the indoor air becomes veiled by Mie scattering. On the other hand, when the density of floating dust of 5 μm or larger particle diameter in indoor air is low, the indoor air becomes clear and comes to look like blue sky caused by Rayleigh scattering. FIG. 26 shows measurement results of floating dust density in an injection molding factory when the parallel flow air curtain device of the present invention was installed in the entrance of the factory. As can be seen from FIG. 26, density of floating dust of 5 μm or larger particle diameter decreases under the operation of the pre-filters provided for the air curtain device, indoor air of the factory becomes clear and comes to look like blue sky, and indoor dust precipitation greatly decreases.

The phenomenon of indoor air becoming clear and coming to look like blue sky means decrease of floating dust density and dust precipitation. Realization of this phenomenon is advantageous in a food factory, perishable food store, exhibition hall, assembling factory, etc. When the air curtain device in accordance with the present invention is installed in the entrance of an art museum, floating dust particles carried into the museum by visitors are captured by the curtain device so that indoor floating dusts decrease, indoor air becomes clear and comes to look like blue sky, and a good art appreciation environment is maintained. When an exhibition-gallery is large, the air curtain device can be installed inside the gallery so as to capture indoor floating dust.

9. Destaticizing Device

The ionized parallel flow air curtain device of the present invention can be used for destaticizing large size electrostatically charged members such as automobile bumpers, etc.

DESCRIPTION OF THE PREFERRED EMBODIMENTS

Results of performance tests of the air curtain device of the present invention will be described.

Figure 24:
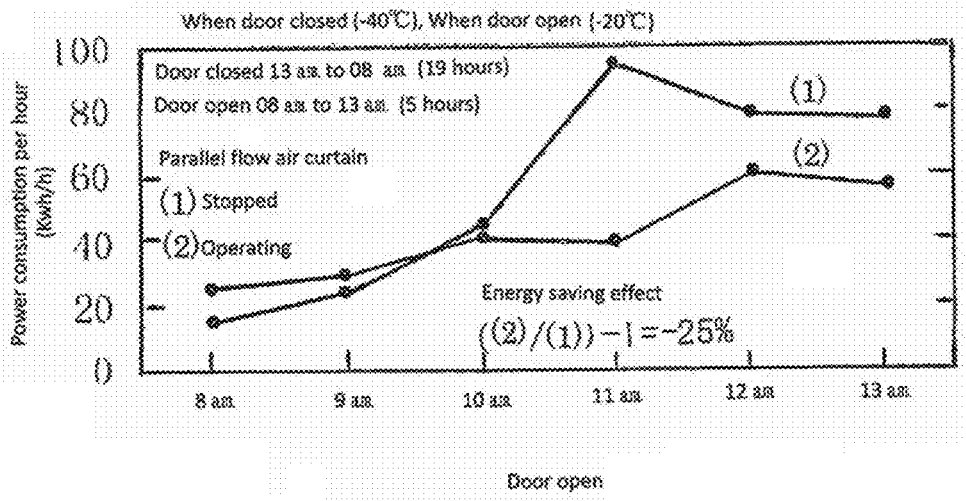
FIG. 24 is a view showing energy saving performance of the parallel flow air curtain device in accordance with the present invention installed in an entrance of a cold storage warehouse.

FIG. 24 shows results of energy saving performance measurement of the parallel flow air curtain device 200 installed in a vegetable cold storage warehouse. The warehouse doorway is opened at 8.00 am, cold vegetables are carried out, normal temperature vegetables are brought in, and the warehouse doorway is closed at 1.00 pm. Inside temperature is set at −40° C. when the doorway is closed and set at −20° C. when the doorway is open. The aforesaid operation cycle is repeated every day. In FIG. 24, curve (1) shows time-dependent change of power consumption when the doorway is open and the parallel flow air curtain device 200 is not used, and curve (2) shows time-dependent change of power consumption when the doorway is open and the parallel flow air curtain device 200 is used. It can be seen from the curve (1) that a large amount of cold air flows out and outdoor air flows in after the doorway is opened at 8.00 am so that power consumption rapidly increases after 10.00 am and becomes constant after 12.00 noon. It can be seen from the curve (2) that outflow of a large amount of cold air is prevented after the doorway is opened at 8.00 am so that rapid increase of power consumption after 10.00 am is prevented though the air curtain is often broken by workers passing through, and power consumption gradually increases due to freezing of the normal temperature vegetables. After the doorway is closed at 1.00 pm, it is estimated that during the operation between then and 8.00 am the freezing vegetables proceeds and power consumption gradually decreases toward the minimum value at the time of doorway opening at 8.00 am.

Energy saving effect of the air curtain is verified by comparing energy consumption of (1) with energy consumption of (2) during the open period of the doorway. Calculation is carried out as follows.

1. Energy consumption W during the five hours the doorway is open between 8.00 am to 1.00 pm is calculated based on the energy consumption curves of FIG. 24.
2. Energy consumption of the curve (1)
   W1=289 Kwh
3. Energy consumption of the curve (2)
   W2=210 Kwh
4. Amount of energy saving during the period the doorway is open
   ΔW=W2−W1=210 Kwh−289 Kwh=−79 Kwh
5. Energy saving ratio during the period the doorway is open
   y=ΔW/W1=−79 Kwh/289 Kwh=−0.27=−27%

It can be seen from the aforesaid calculation that the present air curtain device achieves a high energy saving effect of −27% though the air curtain is often broken by workers passing through.

Figure 1:
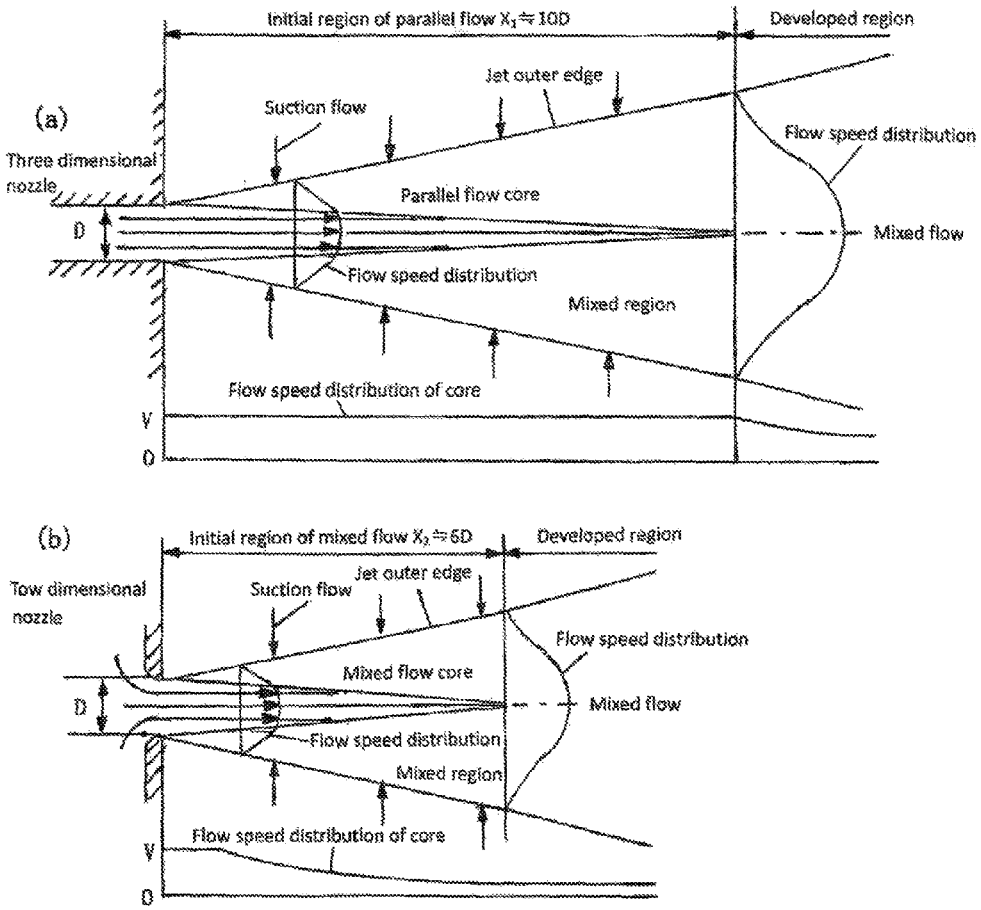
FIG. 1 is a set of views each showing a free jet of turbulent flow.
Figure 2:
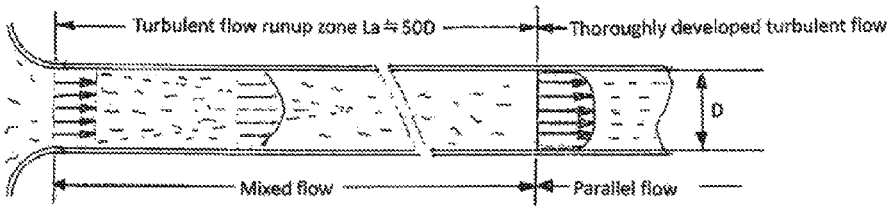
FIG. 2 is a view explaining a runup zone.
Figure 3:
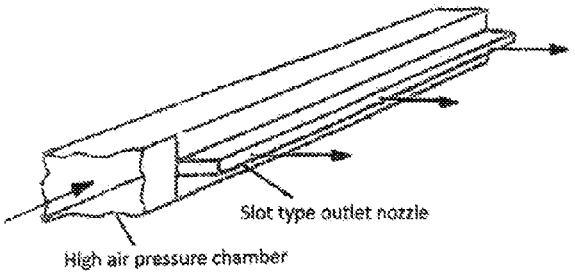
PRIOR ART Fig. 3
FIG. 3 is a view showing a slot type outlet nozzle.
Figure 4:
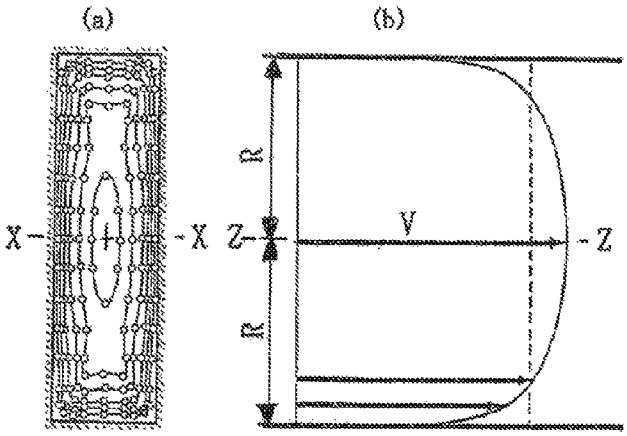
FIG. 4 is a set of views each showing speed distribution of parallel air flow in a duct. (a) shows contour lines of equal speed flows of thoroughly developed turbulent parallel flow in a duct of rectangular cross section after passing through a runup zone. (b) shows speed distribution of thoroughly developed turbulent parallel flow after passing through a runup zone.
Figure 5:
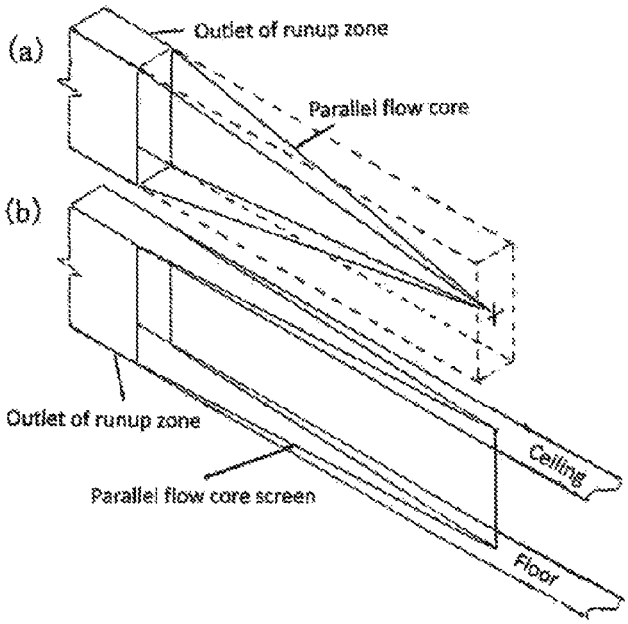
PRIOR ART Fig. 5
FIG. 5 is a set of views each showing a parallel air flow core. (a) shows a parallel air flow core formed near an outlet port formed at an end of a runup zone of a three dimensional axisymmetric rectangular section duct. (b) shows a parallel air flow core screen formed near an outlet port formed at an end of a runup zone of a three dimensional axisymmetric rectangular section duct when only the ceiling and the floor of the duct are extended from the outlet port.
Figure 6:
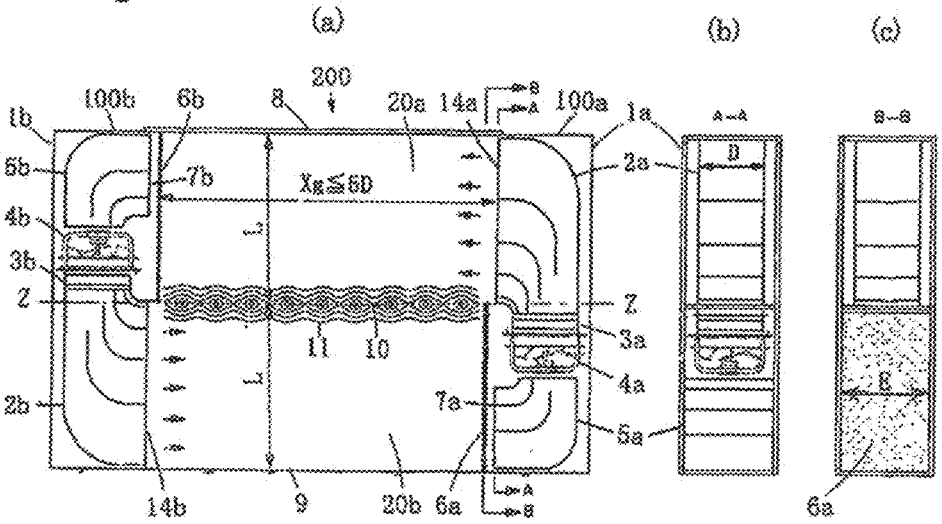
FIG. 6 is a set of structural views of a parallel flow air curtain device. (a) shows a front view, (b) shows a view in the direction of arrows A-A in (a), and (c) shows a view in the direction of arrows B-B in (a).
Figure 7:
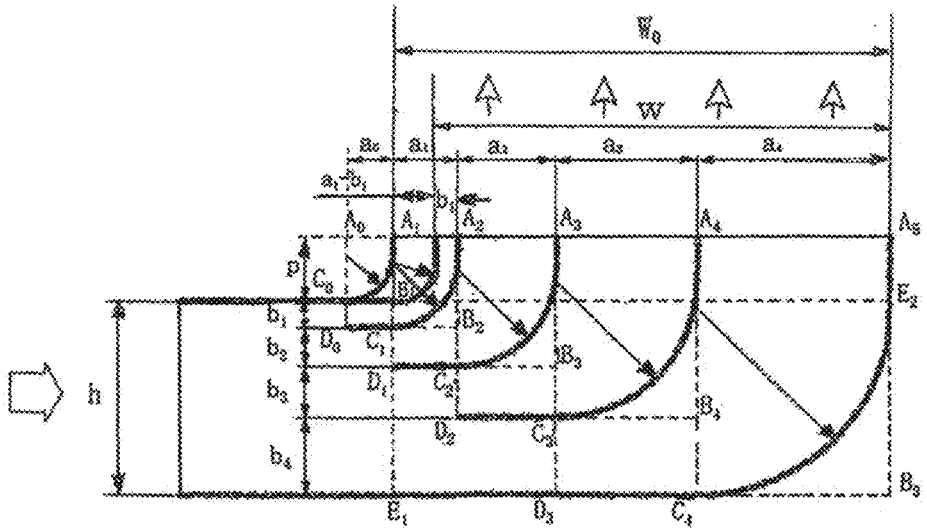
FIG. 7 is a detailed view of a discharge elbow 2*a*.
Figure 8:
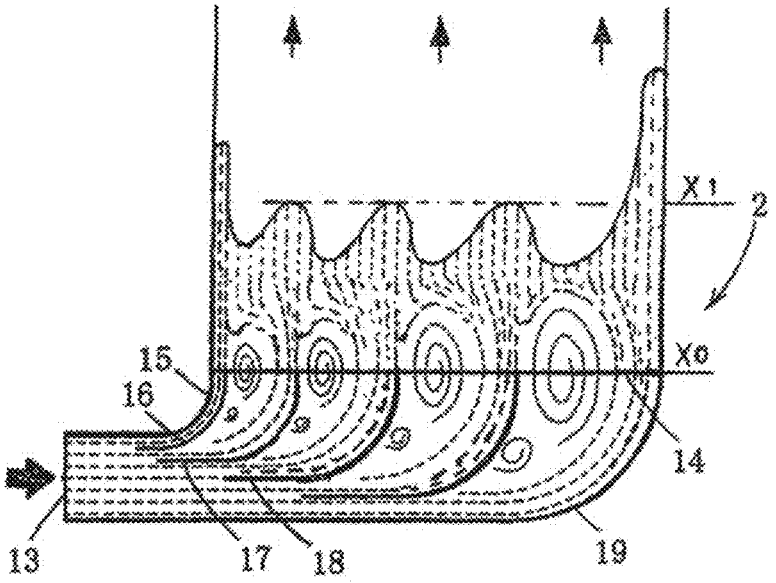
FIG. 8 is a view showing air flow speed distribution in a duct connected to the discharge elbow.
Figure 9:
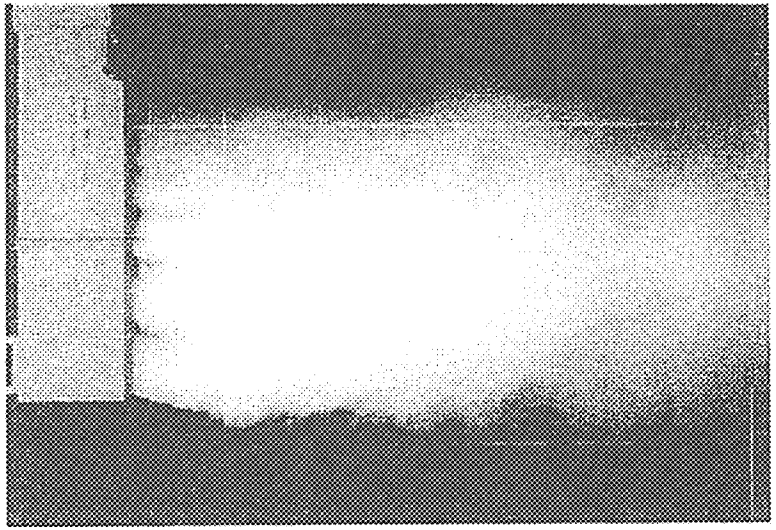
FIG. 9 is a photo showing an air jet of the discharge elbow.
Figure 10:
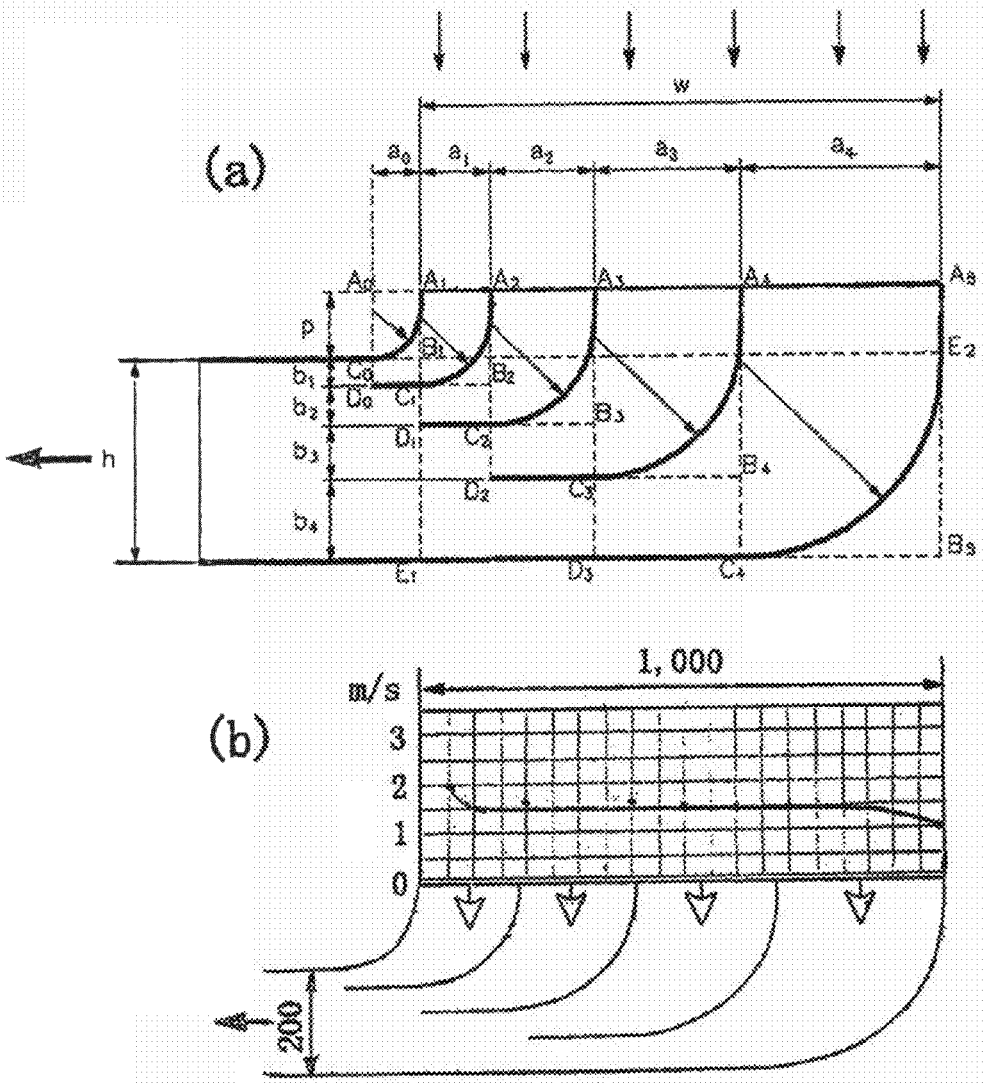
FIG. 10 is a set of structural views of a suction elbow. (a) shows detailed structure and (b) shows suction flow speed distribution.
Figure 11:
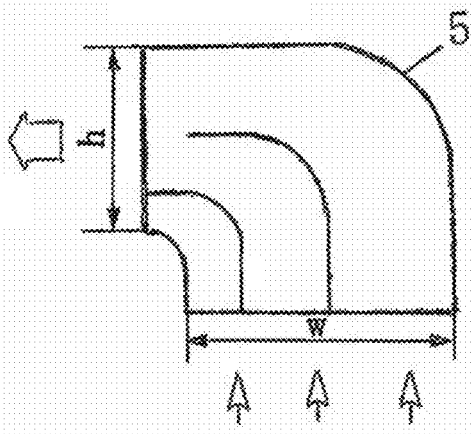
FIG. 11 is a detailed view of a suction elbow 5*a*.
Figure 12:
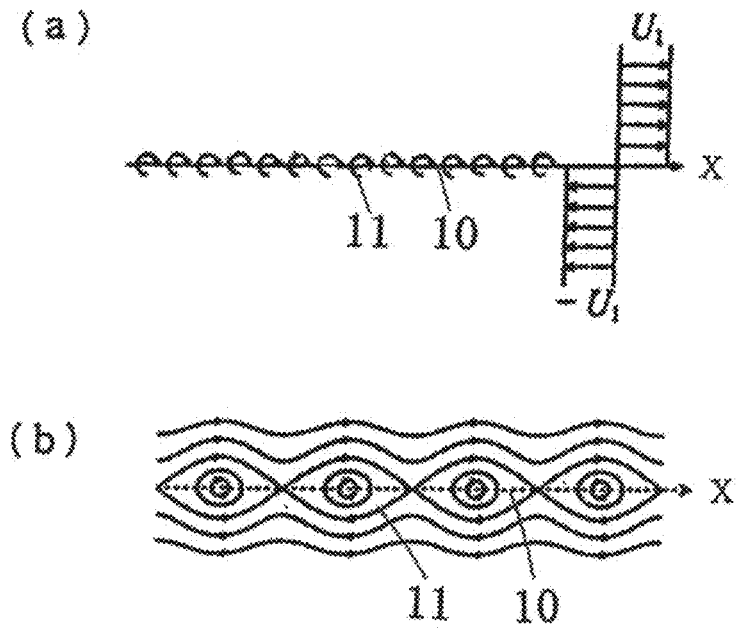
FIG. 12 is a set of views showing a free shear vortex street 11. (a) shows relation among a higher level axially asymmetric flow air screen 20*a*, a lower level axially asymmetric flow air screen 20*b*, and the free shear vortex street 11. (b) shows the free shear vortex street 11.
Figure 13:
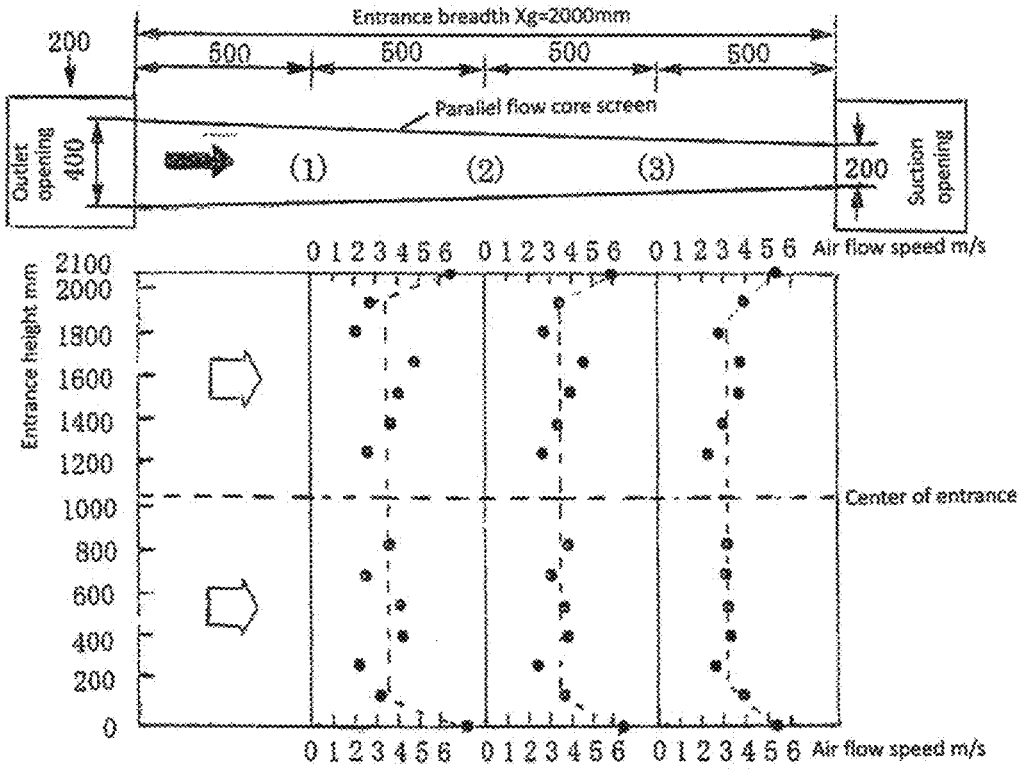
FIG. 13 is a view showing air flow speed distribution of the parallel flow air curtain device.
Figure 14:
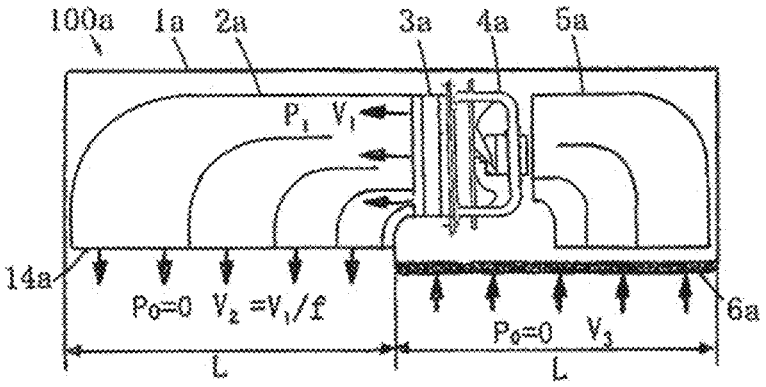
FIG. 14 is a structural view of a ventilation box 100*a*.
Figure 15:
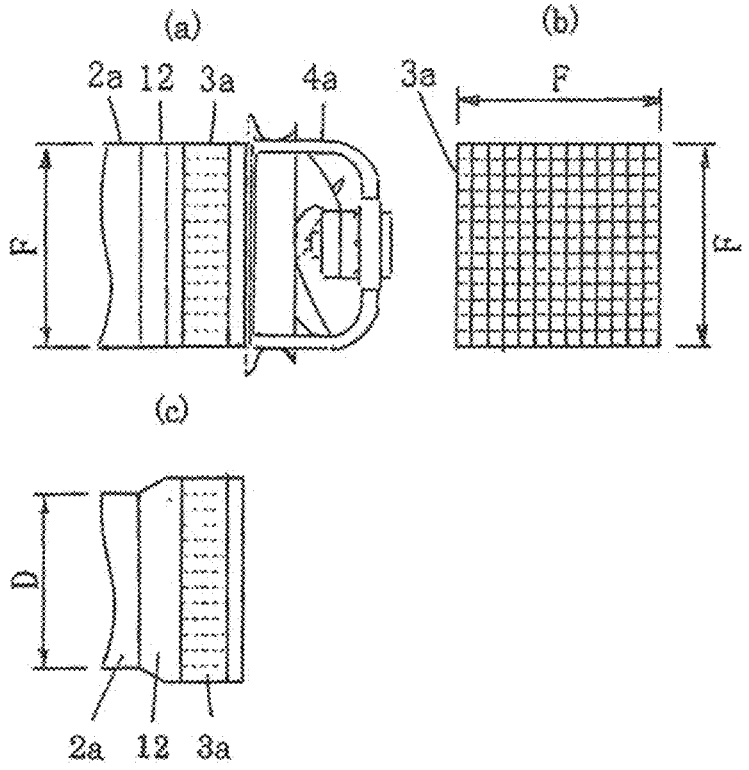
FIG. 15 is a set of detailed structural views of an inlet port of a discharge elbow. (a) shows a side view, (b) shows a front view of a honeycomb 3*a* and (c) shows a top view of a reduction flow duct 12.
Figure 16:
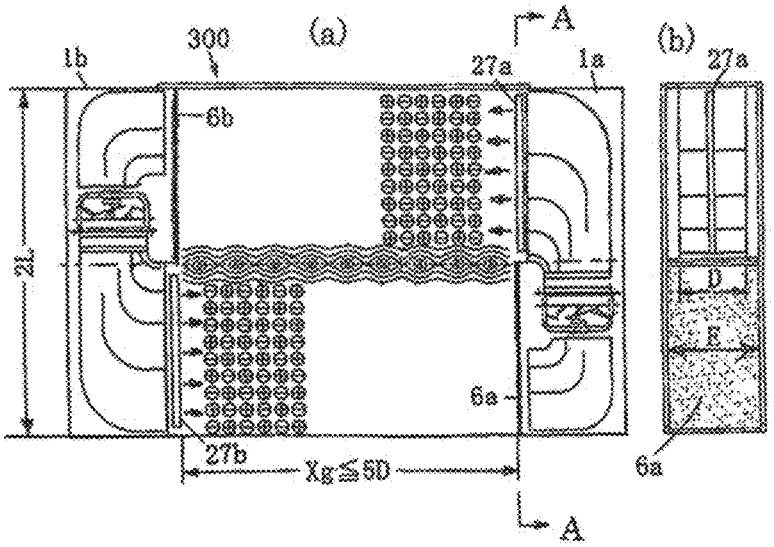
FIG. 16 is a set of structural views of an ionized parallel flow air curtain device 300. (a) shows a front view and (b) shows a view in the direction of arrows A-A in (a).
Figure 17:
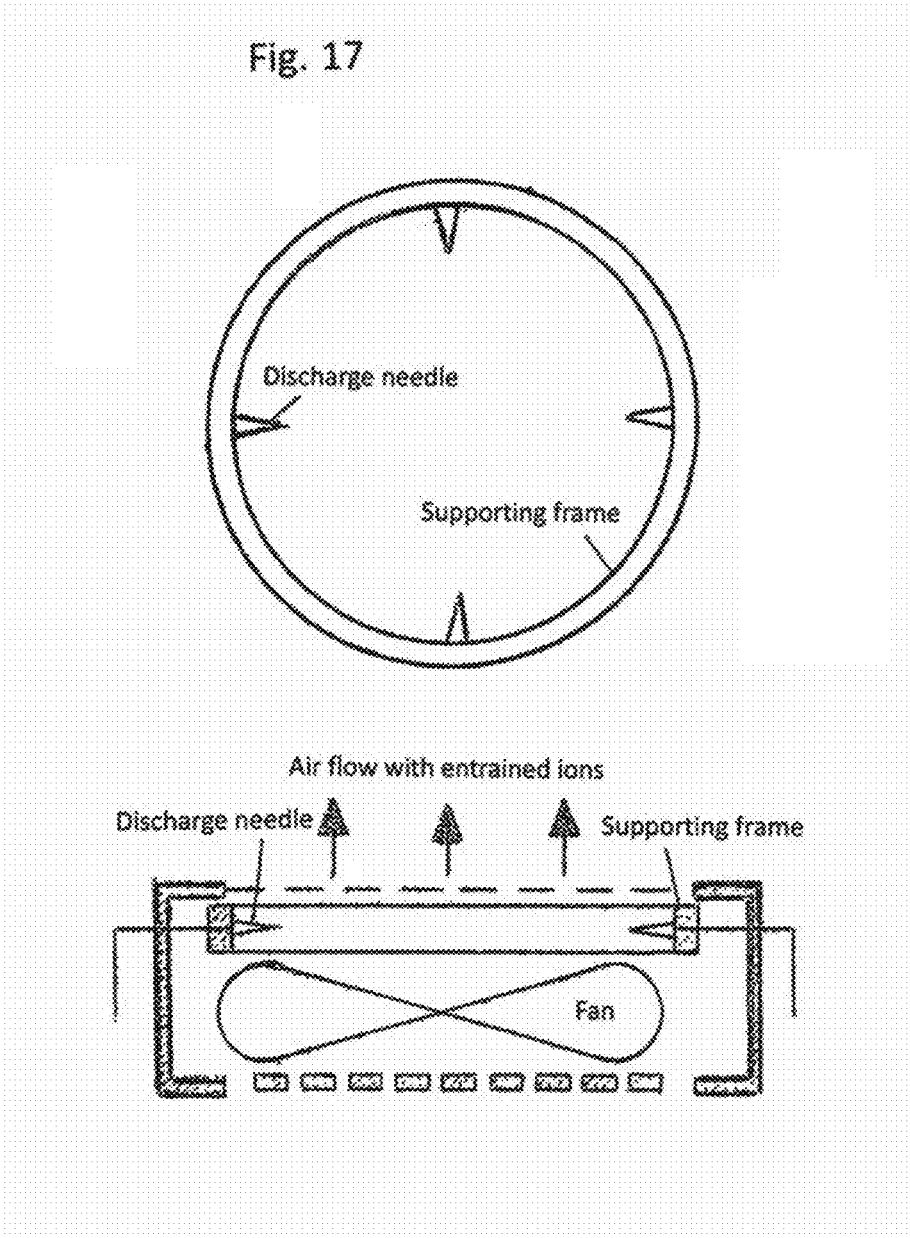
FIG. 17 is a structural view of a conventional blower-type destaticizing device.
Figure 18:
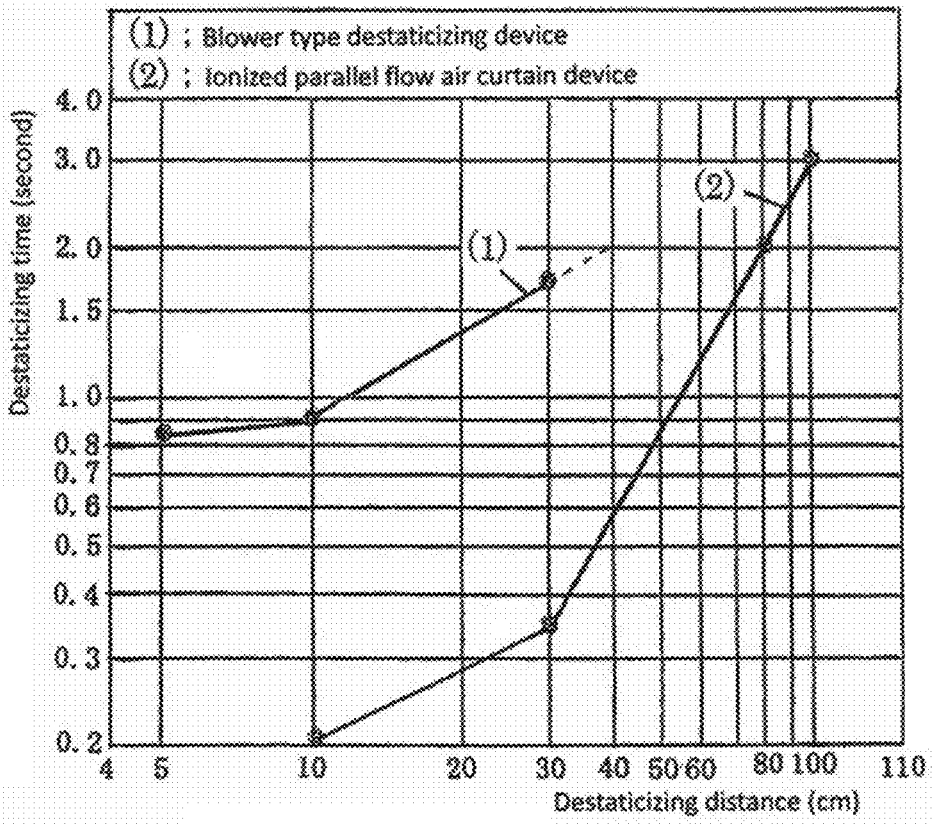
FIG. 18 shows a chart comparing destaticizing time between a conventional destaticizing device and the ionized parallel flow air curtain device.
Figure 19:
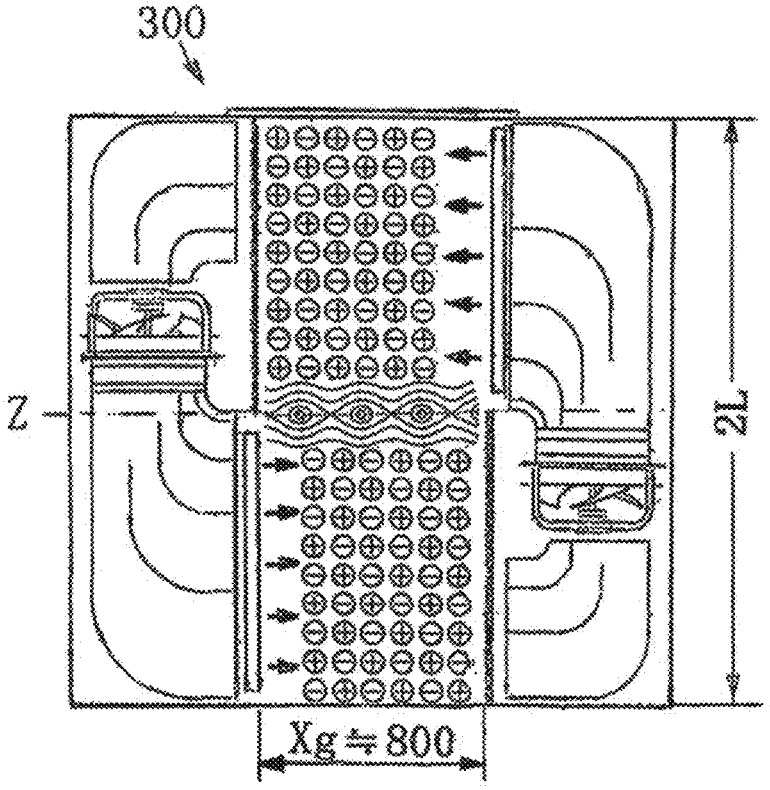
FIG. 19 is a structural view of an ionized parallel flow air curtain device 300 of 80 cm entrance breadth.
Figure 20:
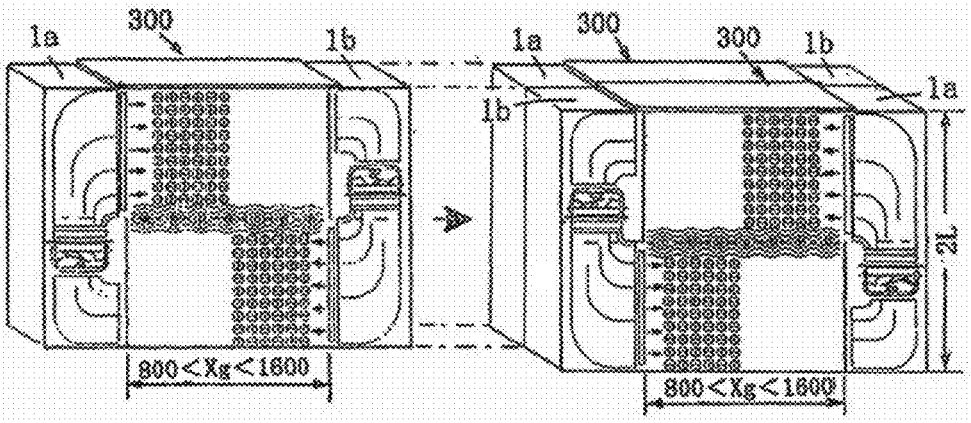
FIG. 20 is a structural view of an ionized parallel flow air curtain device 300 of 160 cm entrance breadth.
Figure 21:
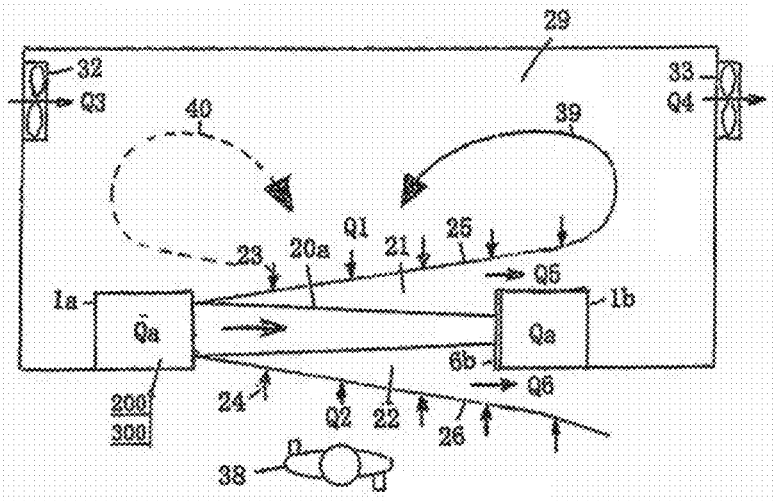
FIG. 21 is a view showing performance of the parallel flow air curtain device in accordance with the present invention installed in an entrance of a class 1 ventilated room (indoor pressure≈0)
Figure 22:
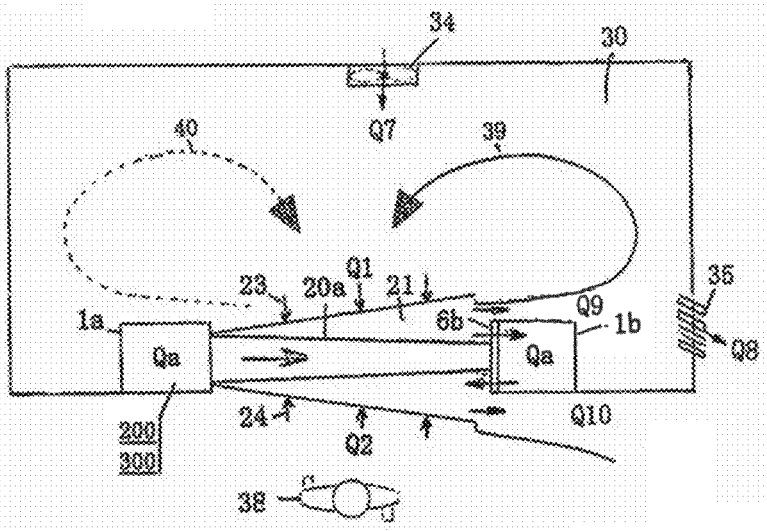
FIG. 22 is a view showing performance of the parallel flow air curtain device in accordance with the present invention installed in an entrance of a class 2 ventilated room (indoor pressure>0)
Figure 25:
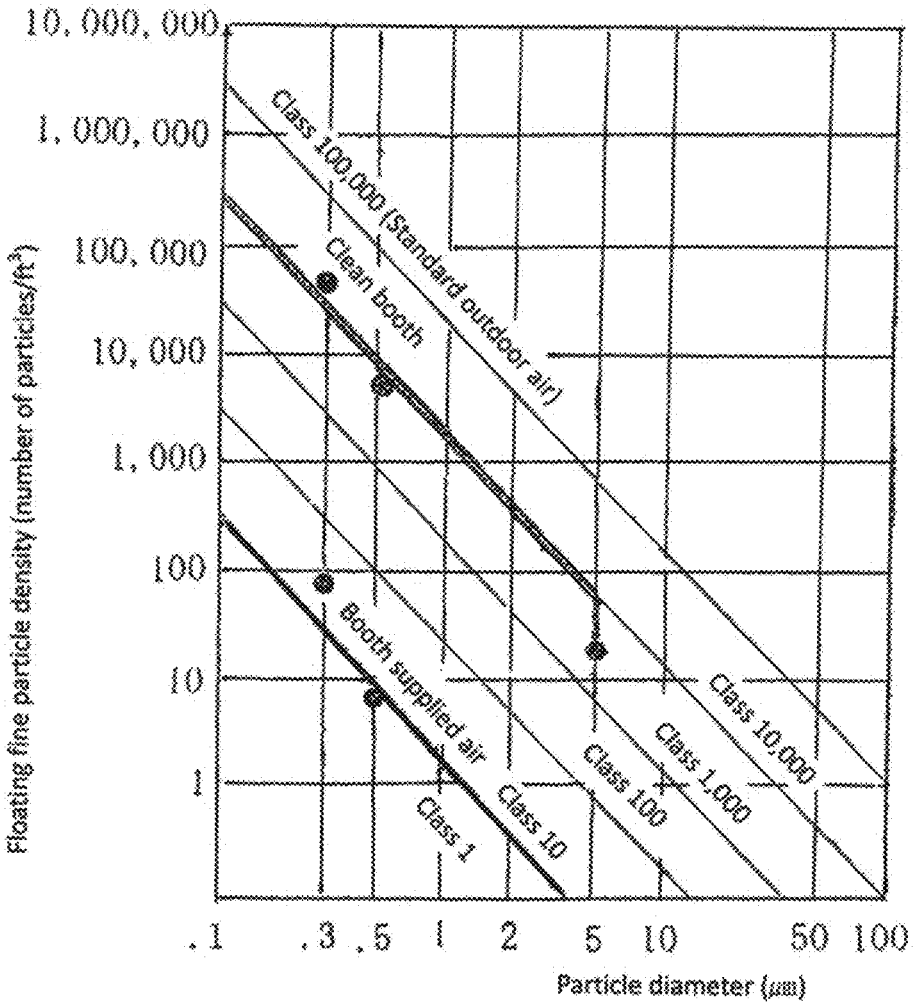
FIG. 25 is a view showing air cleaning performance of the parallel flow air curtain device in accordance with the present invention installed in an entrance of a clean booth.

FIG. 25 shows results of an air cleaning performance measurement of the ionized parallel flow air curtain device 300 shown in FIG. 19 installed in a doorway of a clean booth. The clean booth corresponds to the class 2 ventilated room. Cleanliness of clean air supplied to the clean booth is class 10 and cleanliness of environmental air around the clean booth is class 100,000 corresponding to cleanliness of standard outdoor air. Cleanliness of indoor air of the booth in normal operating condition is class 10,000, i.e., 5 μm density (number of fine particles of diameter equal to or greater than 5 μm) is 80 particles/$ft^3$. When the ionized parallel flow air curtain device 300 is installed in the doorway of the booth, 5 μm density decreases to 11 particles/$ft^3$ (corresponding to class 4,000). The aforesaid result indicates that installation of the air curtain device 300 and supply of clean air can easily achieve a work room wherein 5 μm density is class 4,000.

Figure 23:
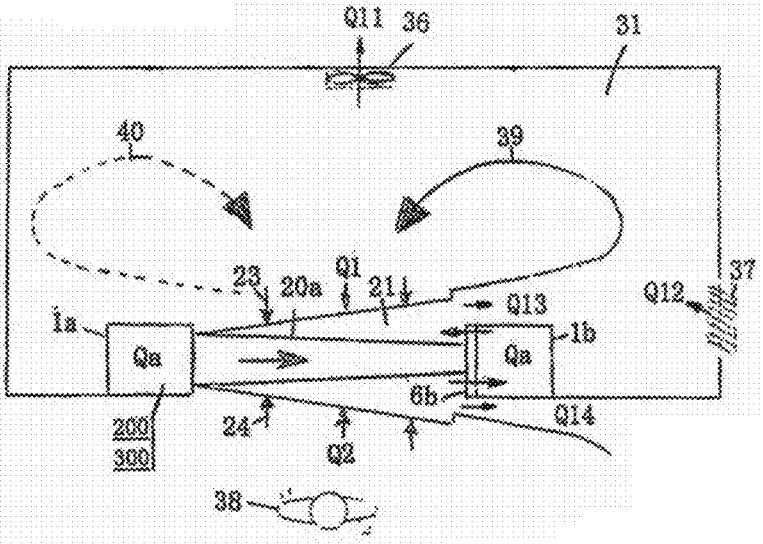
FIG. 23 is a view showing performance of the parallel flow air curtain device in accordance with the present invention installed in an entrance of a class 3 ventilated room (indoor pressure<0)
Figure 26:
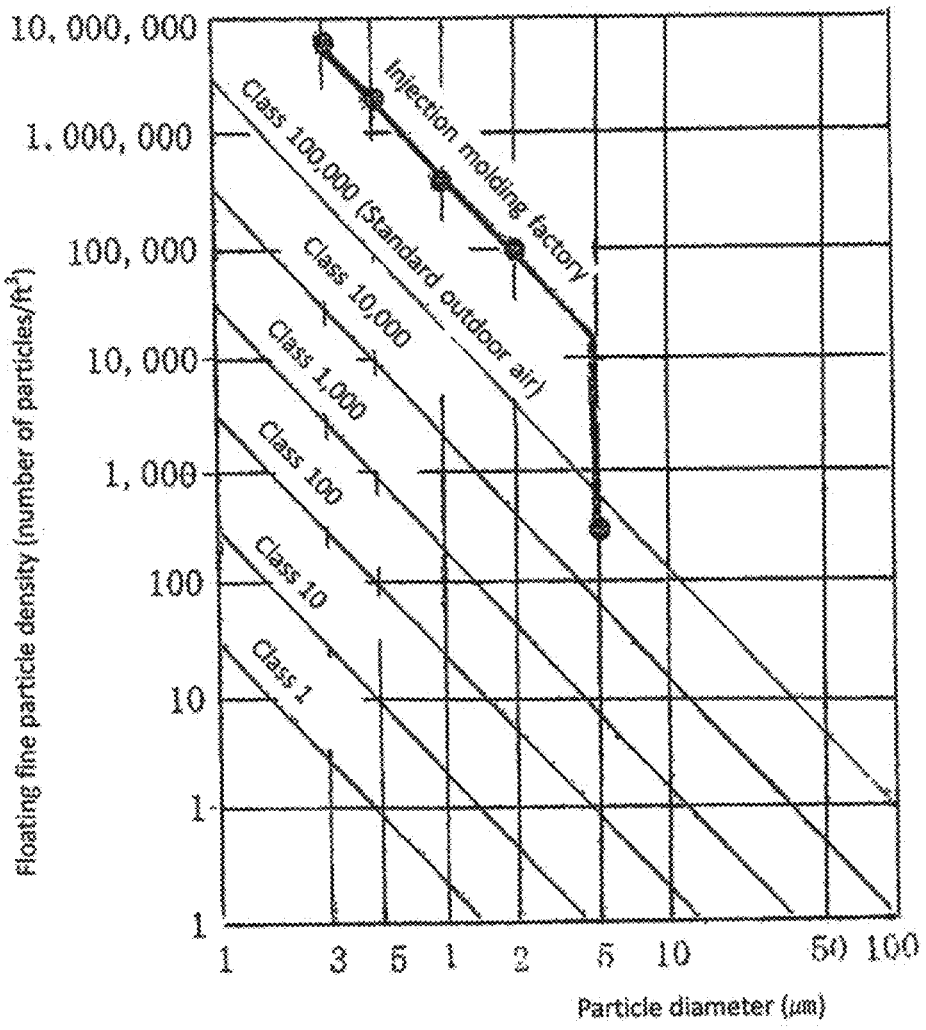
FIG. 26 is a view showing air cleaning performance of the parallel flow air curtain device in accordance with the present invention installed in an entrance of an injection molding factory.

FIG. 26 shows results of measurement of cleanliness of indoor air when the ionized parallel flow air curtain device 300 of FIG. 19 is installed in a doorway of an injection molding factory of 300 $m^2$ site area. The injection molding factory corresponds to the class 3 ventilated room of FIG. 23.

An injection molding factory needs large cooling power because many operations are accompanied by heat generation. When an ionized parallel flow air curtain device in accordance with the present invention is installed in an entrance of the factory, outflow of cold air through the entrance is prevented so that air conditioning power is saved, and air temperature distribution in the factory becomes uniform so that accuracy of temperature control of injection molding machines improves and productivity of the factory increases. Humid air is prevented from flowing into the factory on a rainy day so that rusting of fine and precise metal molds is prevented and the cost of metal mold maintenance decreases.

In an injection molding factory, resin dust is usually generated during cooling solidification of molten resin. As can be seen from FIG. 26, 5 μm density of indoor air of the factory was reduced to class 50,000 level by the adherent electrostatically charged dust destaticizing performance and dust removal performance of the ionized parallel flow air curtain device 300 of 800 mm entrance breadth shown in FIG. 19 installed in the entrance of the factory. In the factory, dust of 5 to 10 μm diameter is suspended in the air all the time during operation. The dust settles after operation is stopped and comes to rest on various equipment, materials, etc. However, after the installation of the ionized parallel flow air curtain device 300, deposit of dust decreased, and the quality of resin products improved. Reduction of floating dust in the factory made the indoor air clear and come to look like blue sky caused by Rayleigh scattering.

As can be seen from the above description, installation of the ionized parallel flow air curtain device 300 in the injection molding factory resulted in (1) energy saving due to air conditioning power saving, (2) quality enhancement of products by decreasing dust suspended in the indoor air, (3) enhancement of productivity by uniformizing air temperature in the factory and (4) decrease of maintenance cost of the metal molds by inhibition of humid air intrusion on a rainy day and prevention of rusting of fine and precise metal molds.

Figure 27:
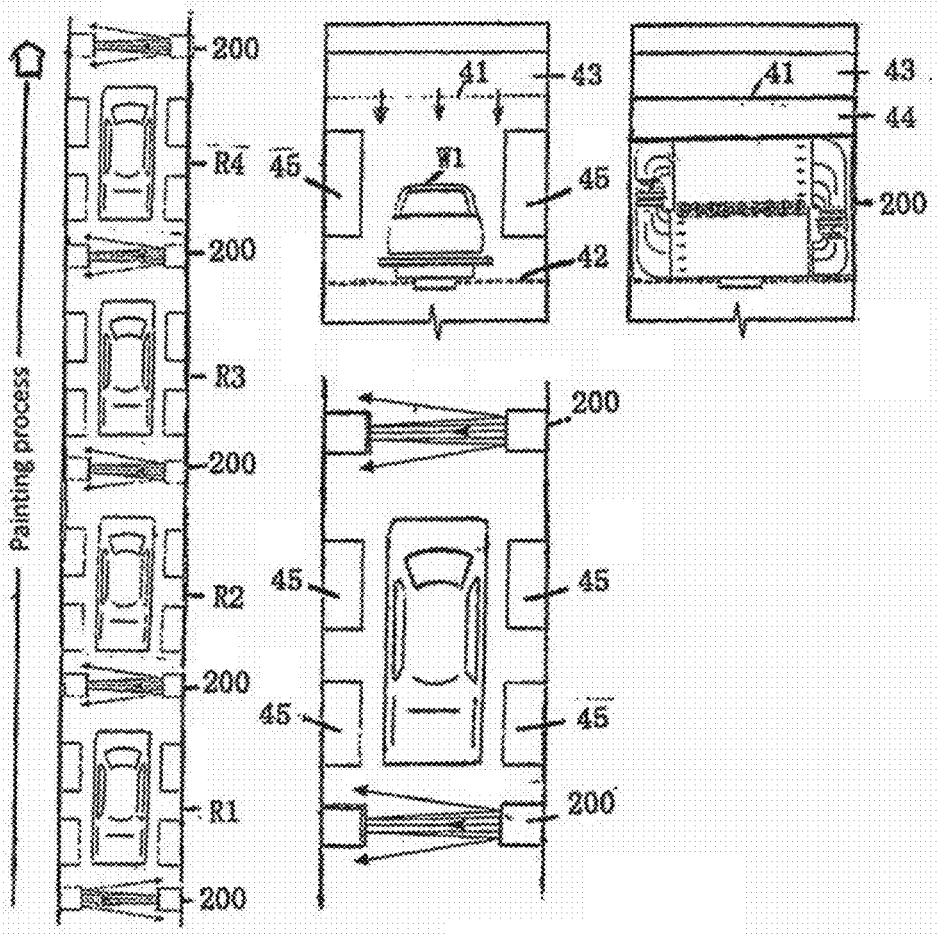
FIG. 27 is a view showing the parallel flow air curtain device in accordance with the present invention installed in an automobile painting booth.

FIG. 27 shows the parallel flow air curtain devices installed in an automobile painting booth. In the painting booth, slow speed air flows downward from outlet openings formed in a ceiling 41 toward suction openings formed in a floor 42 so as to capture and remove paint mists generated during painting work. The downward air flow is a mixed air flow including vortex flows. Therefore, redeposition of paint mists on the works occurs and paint seeds are generated on the painted surface. Reduction of paint seeds removal work is the largest problem in painting work. FIG. 27 shows an effective measure for overcoming this problem. In FIG. 27, each of the cars W1 arranged in series is sandwiched from the front and the back between a pair of air curtain devices of the present invention. Each of the air curtain devices forms the circulation air flows 39 and 40 shown in FIG. 23 in the space surrounding the car W1 so as to entrain the paint mists, thereby capturing the paint mists with the pre-filters 6*a* and 6*b*. Installation of the air curtain devices between the cars W1 makes it possible to shorten the distance between adjacent cars W1 so as to minimize the length of the painting booth.

Figure 28:
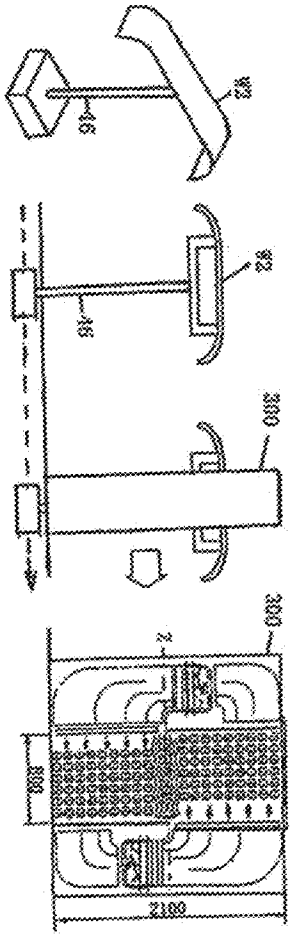
FIG. 28 is a view showing the ionized parallel flow air curtain device in accordance with the present invention used for continuous destaticizing of automobile bumpers.

FIG. 28 shows the ionized parallel flow air curtain device used for continuous destaticizing of automobile bumpers made of polymer material. Works W2 were put on moving carriages 46 and passed through the ionized parallel flow air curtain device 300 so as to be destaticized. Good results were obtained.

The invention claimed is:

1. An air curtain device comprising a first ventilation box comprising a discharge elbow provided with guide vanes, a honeycomb, an industrial use ventilating fan, a suction elbow provided with guide vanes, and a pre-filter, wherein the aforesaid elements are sequentially accommodated in a rectangular box whose one side surface is open and an outlet port of the discharge elbow provided with guide vanes and the pre-filter are disposed on the open side surface of the rectangular box, and a second ventilation box of the same structure as the first ventilation box, wherein the first ventilation box is put on an entrance floor with the discharge elbow provided with guide vanes above, and the second ventilation box is put on the entrance floor with the discharge elbow provided with guide vanes below, so that the first ventilation box and the second ventilation box oppose each other at their open side surfaces in a mutually upside-down manner and the first ventilation box and the second ventilation box are distanced from each other by a breadth Xg of the entrance, and wherein an entrance ceiling is provided to a breadth equal to the distance between the ventilation boxes so as to connect a top of the first ventilation box with a top of the second ventilation box, thereby forming an air curtain device entrance, wherein relation between the breadth Xg of the entrance of the air curtain device and a breadth D of the outlet ports of the discharge elbows provided with guide vanes is set at $Xg \leq 5D$, and wherein the discharge elbow provided with guide vanes comprises an elbow of rectangular cross section and expansion ratio f of $1<f\leq 5$, and one or more guide vanes disposed in the elbow, while the guide vane or the guide vanes are made of a curved plate and a pair of flat plates connected to the curved plate, with one of them being located in front of the curved plate and the other being located to the rear of the curved plate, wherein m number of sub-channels similar to one another are formed in the elbow based on the following formulas, whereafter the inner sidewall of the elbow is deformed into a curved plate coaxial with the curved plate of the adjacent guide vane to deform n=1 sub-channel into a coaxial bend channel provided with a uniform breadth equal to the inlet breadth $b_1$ of the sub-channel, $$p=h/\{[f/(f-r)]^m-1\} \quad (1)$$

$$a_n=pr[f/(f-r)]^n \quad (2)$$

$$b_n=a_n/f \quad (3)$$

$$f=W_0/h \quad (4)$$

$$W=W_0-(a_1-b_1) \quad (5)$$

p: overhang length at the outlet of the elbow
h: inlet breadth of the elbow
$W_0$: baseline outlet breadth of the elbow
W: outlet breadth of the elbow
f: expansion ratio of the elbow ($f=W_0/h$, $1<f\leq 5$)
r: aspect ratio of the sub-channels ($r<f$)
m: number of sub-channels ($m\geq 2$)
$a_n$: outlet breadth of n-th sub-channel ($a_0$ indicates the radius of curvature of the inner sidewall and $a_m$ indicates the radius of curvature of the outer sidewall)
$b_n$: inlet breadth of n-th sub-channel and wherein the suction elbow provided with guide vanes comprises an elbow of rectangular cross section and contraction ratio f of $1<f\leq 5$, and one or more guide vanes made of a curved plate and flat plates connected to the curved plate disposed so as to make the shapes of the sub-channels defined thereby similar to each other based on the following formulas, $$P=h/\{[f/(f-r)]^m-1\} \quad (6)$$

$$a_n=Pr[f/(f-r)]^n \quad (7)$$

$$b_n=a_n/f \quad (8)$$

P: overhang length at the inlet of the elbow
h: outlet breadth of the elbow
W: inlet breadth of the elbow
f: contraction ratio of the elbow ($f=W/h$, $1<f\leq 5$)
r: aspect ratio of the sub-channels ($r<f$)
m: number of sub-channels ($m\geq 2$)
$a_n$: inlet breadth of n-th sub-channel ($a_0$ indicates the radius of curvature of the inner sidewall and $a_m$ indicates the radius of curvature of the outer sidewall)
$b_n$: outlet breadth of n-th sub-channel wherein a higher level non-axisymmetric outlet port and a lower level non-axisymmetric outlet port oppose each other axisymmetrically with respect to a center horizontal plane, a higher level non-axisymmetric jet core screen and a lower level non-axisymmetric jet core screen simultaneously becomes irrotational parallel flows so as to form an upper level parallel flow air curtain and a lower level parallel flow air curtain, whereby the higher level and the lower level oppositely directed air flows form an axisymmetric internally circulating parallel flow air curtain as a whole.

2. An air curtain device of claim 1, wherein an inlet air flow speed of the discharge elbow is reduced to an outlet air flow speed of the discharge elbow at an initial operation stage so as to recover dynamic pressure, thereby keeping an outlet pressure of the industrial use ventilating fan negative at initial operation stage so as to make an operation air flow rate of the higher level parallel flow air curtain and an operation air flow rate of the lower level parallel flow air curtain at initial operation stage equal to free air flow rate of the industrial use ventilating fan.

3. An air curtain device of claim 1, wherein an ion-pole is disposed at each of the outlet port of the discharge elbow of the first ventilation box and the outlet port of the discharge elbow of the second ventilation box, wherein each ion-pole extends over the whole length of the outlet port, and wherein the ion-poles generate ions, so as to ionize the higher level parallel flow air curtain and the lower level parallel flow air curtain, thereby forming an ionized parallel flow air curtain as a whole.

4. An air curtain device of claim 2, wherein an ion-pole is disposed at each of the outlet port of the discharge elbow of the first ventilation box and the outlet port of the discharge elbow of the second ventilation box, wherein each ion-pole extends over the whole length of the outlet port, and wherein the ion-poles generate ions, so as to ionize the higher level parallel flow air curtain and the lower level parallel flow air curtain, thereby forming an ionized parallel flow air curtain as a whole.

* * * * *